US006512505B1

(12) United States Patent
Uchino et al.

(10) Patent No.: US 6,512,505 B1
(45) Date of Patent: Jan. 28, 2003

(54) LIQUID CRYSTAL DISPLAY APPARATUS, ITS DRIVING METHOD AND LIQUID CRYSTAL DISPLAY SYSTEM

(75) Inventors: Katsuhide Uchino, Kanagawa (JP); Kazuhiro Noda, Kanagawa (JP); Toshikazu Maekawa, Kanagawa (JP); Hideyuki Kitagawa, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/524,284

(22) Filed: Mar. 13, 2000

(30) Foreign Application Priority Data

Mar. 16, 1999 (JP) ..... 11-069643
Mar. 19, 1999 (JP) ..... 11-074789

(51) Int. Cl.[7] ..... G09G 3/36
(52) U.S. Cl. ..... 345/96; 345/87
(58) Field of Search ..... 345/96, 87, 95, 345/94, 99, 208, 209, 210, 100

(56) References Cited

U.S. PATENT DOCUMENTS 5,253,091 A * 10/1993 Kimura et al. ..... 345/87
5,790,092 A * 8/1998 Moriyama ..... 345/209
5,892,493 A * 4/1999 Enami et al. ..... 345/100
6,020,870 A * 2/2000 Takahashi et al. ..... 345/92
6,243,062 B1 * 6/2001 den Boer et al. ..... 345/91
6,327,008 B1 * 12/2001 Fujiyoshi ..... 345/96

FOREIGN PATENT DOCUMENTS

EP 0678848 A1 10/1995
EP 0678849 A1 10/1995
EP 0737957 A1 10/1996
EP 0755044 A1 1/1997
EP 0838801 A1 4/1998
EP 0907159 A3 4/1999
JP 5-134629 5/1993
JP 7-318901 12/1995
JP 10-143113 5/1998
JP 11-64893 3/1999

* cited by examiner

*Primary Examiner*—Vijay Shankar
*Assistant Examiner*—Nitin Patel
(74) *Attorney, Agent, or Firm*—Rader, Fishman & Grauer PLLC; Ronald P. Kananen, Esq.

(57) ABSTRACT

First aspect of the present invention:

In dot inversion driving, polarities of image signals written to contiguous left and right ones of pixels differ from each other and accordingly, a domain is produced at corners of an opening portion, as a result, an aperture rate of the pixel is lowered and the transmittivity is deteriorated.

In the case of an active matrix type TFT liquid crystal display apparatus of a dot successive driving system, gate lines Vg1 through Vg5 are wired to meander between the pixels of two upper and lower lines, Cs lines are wired in a matrix shape, image signals video1 and video2 having polarities inverse to each other are simultaneously written to the pixels of different upper and lower two lines and polarities of the pixels in a pixel arrangement after the writing operation are made the same polarity between contiguous left and right ones of the pixels and inverse polarities between upper and lower ones of the pixels.

6 Claims, 14 Drawing Sheets

| | | | | |
|---|---|---|---|---|
| (d-1) − | | (d-3) − | | (DUMMY) |
| (1-1) + | (1-2) + | (1-3) + | (1-4) + | 1-TH ROW |
| (2-1) − | (2-2) − | (2-3) − | (2-4) − | 2-TH ROW |
| (3-1) + | (3-2) + | (3-3) + | (3-4) + | 3-TH ROW |
| (4-1) − | (4-2) − | (4-3) − | (4-4) − | 4-TH ROW |
| | (d-2) + | | (d-4) + | (DUMMY) |

| | | | |
|---|---|---|---|
| + | − | + | − |
| − | + | − | + |
| + | − | + | − |
| − | + | − | + |

FIG.21 LELATED ART
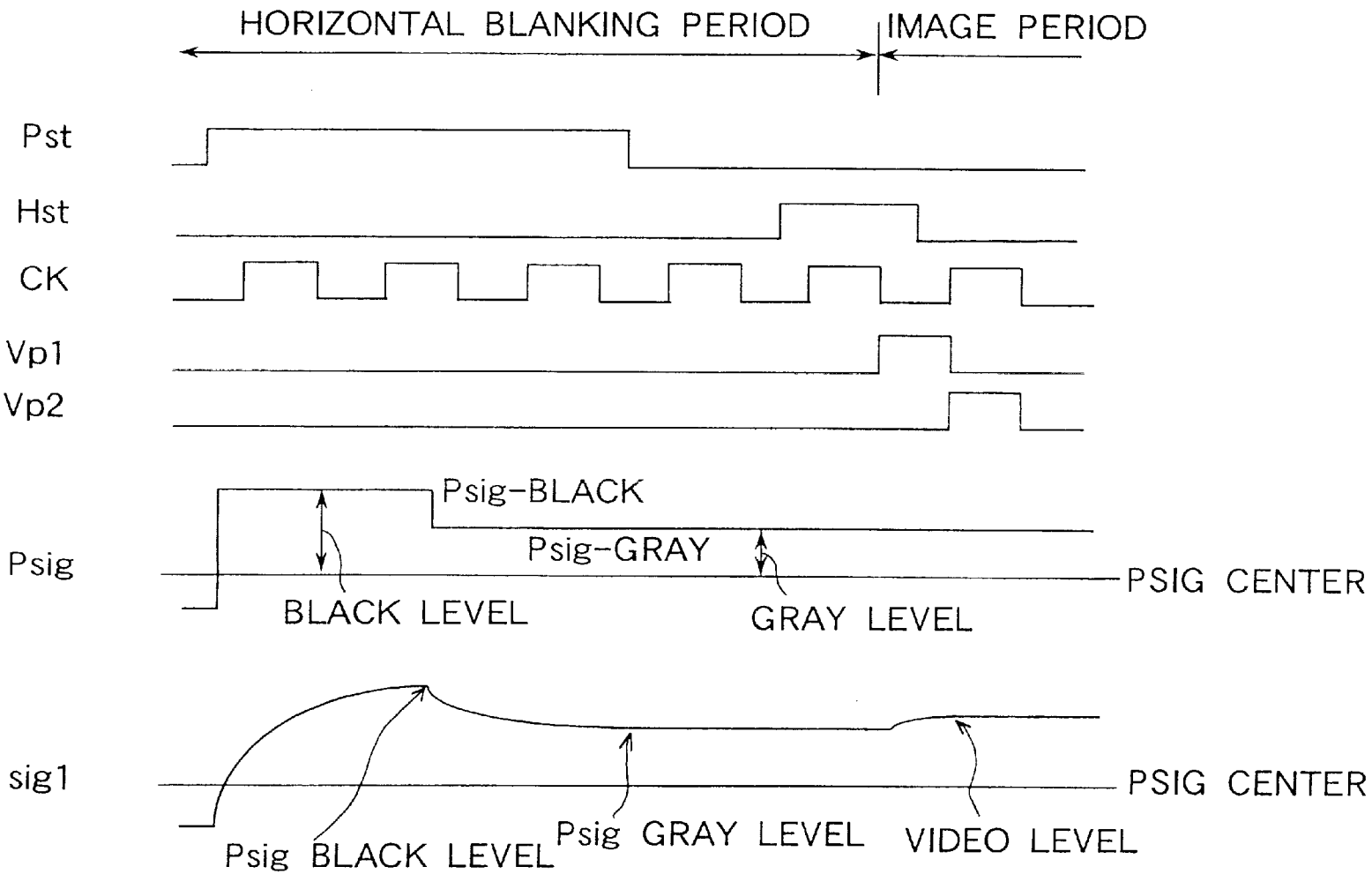

LIQUID CRYSTAL DISPLAY APPARATUS, ITS DRIVING METHOD AND LIQUID CRYSTAL DISPLAY SYSTEM

BACKGROUND OF THE INVENTION

1. Field of the Invention

The present invention relates to a liquid crystal display apparatus and its driving method as well as a liquid crystal display system, particularly to an active matrix type liquid crystal display apparatus of a dot successive driving system for successively driving respective pixels arranged in a matrix shape for respective line (row) in units of pixels and its driving method as well as a liquid crystal display system using the liquid crystal display apparatus.

2. Description of the Related Art

An explanation will firstly be given of a first problem which the present invention intends to resolve. According to an active matrix type liquid crystal display apparatus, normally, as switching elements of respective pixels, thin film transistors (TFT) are used. FIG. 7 shows an example of a constitution of such an active matrix type TFT liquid crystal display apparatus. In this case, for simplicity, there is shown, for example, a case of an arrangement of four rows and four columns of pixels.

Pixels 101 are arranged in a matrix shape at intersecting portions of respectives of gate lines Vg1 through Vg4 and respectives of signal lines sig1 through sig4 in FIG. 7. The pixels 101 are constructed by a constitution having thin film transistors TFTs gate electrodes of which are connected to the gate lines Vg1 through Vg4 and source electrodes (or drain electrodes) of which are connected to the signal lines sig1 through sig4 and hold capacitors Cs one electrode of each of which is connected to the drain electrode (or source electrode) of the thin film transistor TFT. Further, in this case, for simplifying the drawing, a liquid crystal cell LC is omitted. A pixel electrode of the liquid crystal cell LC is connected to the drain electrode of the thin film transistor TFT.

According to the pixel structure, opposed electrodes of the liquid crystal cells LC, not illustrated, and other electrodes of the hold capacitors Cs are connected to a Cs line 102 commonly among the respective pixels. Further, direct current voltage is applied on the opposed electrodes of the liquid crystal cells LC, not illustrated, and the other electrodes of the hold capacitors Cs as common voltage Vcom via the Cs line 102.

A scanning driver 103 carries out a processing of selecting the pixels 101 in units of rows by successively scanning the gate lines Vg1 through Vg4 at every vertical period (1 field period). In the meantime, a source driver 104 carries out a processing of successively sampling, for example, image signals video1 and video2 inputted by two routes at every horizontal period (1H) and writing sampled image signals to the pixels 101 of a row selected by the scanning driver 103.

According to the source driver 104, specifically, sampling switches sw1 through sw4 are alternately connected between the respective signal lines sig1 through sig4 of the pixel unit and respective input signal lines 105-2 and 105-1 of the image signals video2 and video1 and the sampling switches sw1 through sw4 in pairs of twos are successively made ON in response to sampling pulses Vh1 and Vh2 successively outputted from respective transmitting stages 106-1 and 106-2 of shift registers.

In the case of the active matrix type TFT liquid crystal display apparatus having the above-described constitution, as a system of driving thereof, there is known a dot successive driving system for successively driving the respective pixels at every line (every row) in units of pixels. In carrying out the dot successive driving, in the case of a 1H inversion driving system, in one horizontal line, the sampling switches sw1 through sw4 are made ON in a dot successive manner by the sampling pulses Vh1 and Vh2 and as shown by FIG. 8, image signals in the same polarity (video1 and video2 are in the same polarity) are written to the respective pixels 101 via the respective signal lines sig1 through sig4. As a result, as shown by FIG. 9, the image signals in the same polarity (+/−) are written to contiguous left and right ones of the pixels.

In the meantime, resistor components RCs are present between the contiguous left and right ones of the respective pixels in the Cs line 102, further, parasitic capacitances c1 are present between the Cs line 102 and the signal lines sig1 through sig4 and accordingly, a differentiating circuit is formed by the resistor component RCs, the hold capacitor Cs and the parasitic capacitance c1 and accordingly, in writing the image signals video1 and video2, the image signals video1 and video2 are inputted to the Cs lines 102 and the gate lines Vg1 through Vg4 via the hold capacitors Cs and the parasitic capacitances c1.

Thereby, as shown by FIG. 8, potential VCs of the Cs line 102 is deviated in a direction of the same polarity of the image signals video1 and video2 (ΔVCs) and accordingly, cross talk in the horizontal direction (hereinafter, abbreviated as horizontal cross talk) shown by FIG. 10 becomes significant, a failure in shading is caused and image quality is considerably deteriorated. In FIG. 10, a portion indicated by a black region designates an actual image 111 which is actually displayed, a false image (a portion indicated by a dotted region) 112 is produced on a side of the actual image 111 in the horizontal direction.

Further, during a time period in which the pixel 101 holds pixel information in one field period, potential Vsig of the signal lines sig1 through sig4 is deviated at every "H" (ΔVsig) Here, in the case of the 1H inversion driving system, the polarity of the image signals written to the contiguous left and right ones of the pixels stays the same and accordingly, the deviation ΔVsig of the potential of the signal lines sig1 through sig4 is increased.

Further, in respectives of the pixels 101, parasitic capacitances are present also between the source/drain electrodes of the thin film transistors TFT and the respectives of the signal lines sig1 through sig4 and accordingly, the deviation ΔVsig of the potential of the signal lines sig1 through sig4 is inputted to the pixels by source/drain couplings of the thin film transistors and accordingly, cross talk in the vertical direction (hereinafter, abbreviated as vertical cross talk) becomes significant to thereby constitute a factor of a failure in image quality similar to the horizontal cross talk.

There is provided the dot inversion driving system as a driving method of preventing a deviation ΔVcs of the potential of the Cs line 102 and the deviation ΔVsig of the potential of the signal lines sig1 through sig4 from causing. In the case of the dot inversion driving system, the two image signals video1 and video2 are inputted in inverse polarities (however, similar to the case of the 1H inversion driving system, respective polarities of the image signals video1 and video2 in the inverse polarities are inverted at every "H"). Thereby, when the switches sw1 and sw2 are made ON in response to the sampling pulse Vh1, as shown by FIG. 11, the image signal video1 and the image signal video2 are simultaneously written in the inverse polarities and accordingly, the deviations ΔVcs and ΔVsig of the potential are canceled between the contiguous ones of the pixels and accordingly, there poses no problem of the failure in image quality as in the case of the 1H inversion driving system.

However, in the case of the above-described dot inversion driving system, as is apparent from FIG. 12, the polarities of the image signals video1 and video2 written to the contiguous left and right ones of the pixels differ from each other and accordingly, influence of an electric field of a contiguous one of the pixel is effected. Then, a domain (light deficient domain) 122 is produced at corners of an opening portion 121, the portion cannot be used as the opening portion 121 and accordingly, a light shielding portion 123 is obliged to constitute as shown by FIG. 13. Therefore, an aperture ratio of the pixel is lowered, the transmittivity is reduced and accordingly, the contrast is lowered and a failure in image quality is resulted.

Next, a description will be given of a second problem which the present invention intends to resolve. According to the active matrix type liquid crystal display apparatus, normally, the thin film transistor (TFT) is used as the switching element of the respective pixel. In the case of the active matrix type TFT liquid crystal display apparatus, in carrying out the dot successive driving, according to the 1H inversion driving system of inverting the polarity of an image signal inputted to the respective pixels is inverted at every "H" (notation H designates a horizontal period), when charge/discharge current caused by writing the image signal to the signal line wired at respective column of the pixel unit is large, a vertical streak appears on a display screen.

There is known a precharge system for previously writing a precharge signal level prior to writing the image signal in order to restrain the charge/discharge current caused by writing the image signal as less as possible. FIG. 18 shows an example of a constitution of such an active matrix type TFT liquid crystal display apparatus of the dot successive precharge system. In this case, for simplicity, there is shown a case of an arrangement of four rows and four columns of pixels as an example.

In FIG. 18, pixels 101A are arranged in a matrix shape at intersecting portions of respectives of gate lines Vg1A through Vg4A and respectives of signal lines sig1A through sig4A. The pixels 101A are constructed by a constitution having thin film transistors TFT gate electrodes of which are connected to the gate lines Vg1A through Vg4A and source electrodes (or drain electrodes) of which are connected to the signal lines sig1A through sig4A, respectively, and the hold capacitors Cs the one electrode of each of which is connected to a drain electrode (or source electrode) of the thin film transistor TFT. Further, in this case, for simplifying the drawing, the liquid crystal cell LC is omitted. The pixel electrode of the liquid crystal cell LC is connected to the drain electrode of the thin film transistor TFT.

According to the pixel structure, the opposed electrode of the liquid crystal cell LC, not illustrated, and the other electrode of the hold capacitor Cs are connected to a Cs line 102A commonly among the respective pixels. Further, predetermined direct current voltage is applied on the opposed electrode of the liquid crystal cell LC, not illustrated, and the other electrode of the hold capacitor Cs as the common voltage Vcom via the Cs line 102A.

A scanning driver 103A is arranged, for example, on the left side of the pixel unit. The scanning driver 103A carries out a processing of selecting the pixels 101A in units of rows by successively scanning the gate lines Vg1A through Vg4A at every vertical period (every field period). Further, a source driver 104A is arranged, for example, on an upper side of the pixel unit and a precharge driver 105A is arranged, for example, on a lower side, respectively.

The source driver 104A successively samples an image signal video which is inputted via an image signal line 106A and polarities of which are inverted at every "H" and writing the sampled image signal to the pixels 101A of a row selected by the scanning driving 103A. That is, sampling switches hsw1A through hsw4A connected between the respective signal lines sig1A through sig4A of the pixel unit and the image signal line 106A, are successively made ON in response to sampling pulses Vh1 through Vh4 successively outputted from respective transmitting stages 107-1A through 107-4A of shift registers.

The precharge driver 105A carries out a processing of successively sampling a precharge signal level Psig inputted in a polarity the same as a polarity of the image signal video via a precharge signal line 108A and writing the sampled precharge signal to the pixels 101A of a row selected by the scanning driver 103A prior to the image signal video. That is, sampling switches psw1A through psw4A connected between the respective signal lines sig1A through sig4A of the pixel unit and the precharge signal line 108A, are successively made ON in response to sampling pulses Vp1 through Vp4 successively outputted from respective transmitting stages 109-1A through 109-4A of shift registers.

Next, an explanation will be given of operation of the active matrix type TFT liquid crystal display apparatus of the dot successive precharge system having the above-described constitution in reference to timing charts of FIG. 19.

First, the sampling pulses Vp1 through Vp4 are successively outputted in synchronism with a horizontal clock CK in response to a precharge start pulse Pst from the respective transmitting stages 109-1A through 109-4A of the shift registers in the precharge driver 105A. In the meantime, the sampling pulses Vh1 through Vh4 are successively outputted in synchronism with the horizontal clock CK while being retarded by a half clock of the horizontal clock CK relative to the sampling pulses Vp1 through Vp4 in response to a horizontal start pulse Hst from the respective transmitting stages 107-1A through 107-4A of the shift registers in the source driver 104A.

Thereby, at the respective rows successively selected by the scanning driver 103A, firstly, the precharge signal level Psig is written to the signal line sig1A by making ON the sampling switch psw1A in response to the sampling pulse Vp1A, successively, the image signal level video is written to the signal in sig1A by making ON the sampling switch hsw1A in response to the sampling pulse Vh1. Thereafter, the precharge signal level Psig and the image signal level video are written to the signal line sig1A in the dot successive manner by the sampling pulses Vp2 through Vp4 and the sampling pulses Vh2 through Vh4.

In this way, according to the active matrix type TFT liquid crystal display apparatus, prior to writing the image signal video to the signal lines sig1A through sig4A, by previously writing the precharge signal level Psig in the dot successive manner, a signal level in writing the image signal video can be reduced and the charge/discharge current in writing the image signal video can be restrained and accordingly, production of the vertical streak can be prevented.

In the meantime, the precharge signal level Psig must be set to a gray level which is easiest to see the vertical streak. However, when the precharge signal level Psig is set to the gray level, in displaying a window pattern or the like, there is produced cross talk in the vertical direction (hereinafter, abbreviated as vertical cross talk) owing to a difference of a light leakage amount between the source and the drain of the pixel transistor (thin film transistor) depending on locations of image and therefore, the image quality is deteriorated.

In order to prevent the vertical cross talk from being produced, the precharge signal level Psig may be set to a black level whereby leakage current between the source and the drain of the pixel transistor can be made uniform over an entire screen. However, when the precharge signal level Psig is set to the black level, the above-described vertical streak is produced. That is, the vertical cross talk and the vertical streak are in a relationship of tradeoff.

Hence, the inventors have proposed an active matrix type TFT liquid crystal display apparatus of a so-to-speak two step integral precharge system in which the black level and the gray level are precharged integrally in two steps. FIG. 20 shows an example of a constitution of such an active matrix type TFT liquid crystal display apparatus of the two step integral precharge system. Further, this constitution differs from the active matrix type TFT liquid crystal display apparatus of the dot successive precharge system only in the constitution of the precharge driver.

That is, according to a precharge driver 105'A, whereas a precharge signal level Pstg of two steps having the black level and the gray level is inputted through the precharge signal line 108A, the sampling switches psw1A through psw4A connected between the respective signal lines sig1A through sig4A and the precharge signal line 108A, are applied commonly with a precharge control pulse Pcg via a control line 110A.

FIG. 21 shows a timing relationship in the case of the two step integral precharge system. As is apparent from timing charts thereof, the precharge control pulse Pcg is produced in a horizontal blanking period. Thereby, in the horizontal blanking period, firstly, the black level and successively the gray level of the two step precharge signal Pstg are integrally written to the signal lines sig1A through sig4A, thereafter, the image signal video is written to the signal line sig1A through sig4A in the dot successive manner.

In this way, by inputting the precharge signal Pstg of the two steps in the horizontal blanking period and carrying out the integral precharging to the signal lines sig1A through sig4A, firstly, the black level is written to thereby eliminate the vertical cross talk produced owing to the leakage current between the source and the drain of the pixel transistor and thereafter, the gray level is written thereto to thereby eliminate the vertical streak produced owing to the charge/discharge current in writing the image signal video.

However, according to the two step integral precharge system, although there is achieved an excellent effect of capable of improving failures in image quality by eliminating both of the vertical cross talk and the vertical streak, there poses a problem in which the system is not applicable to an image format having a short horizontal blanking period since the precharging operation needs to carry out in the two steps of the black level and the gray level in the horizontal blanking period.

In recent years, there is a tendency of increasing a number of pixels in accordance with high resolution formation, when the number of pixels increases, the horizontal blanking period of the image format is shortened and according to display standards of high vision (HD) and UXGA (ultra extended graphics array), the horizontal blanking period is much shortened. Taking an example of the UXGA display standard, the pixel unit is constituted by horizontal 1600 pixels×vertical 1400 pixels, the horizontal blanking period is, for example, 2.4 μsec and accordingly, the precharge time period cannot be secured by a delay in a scanning pulse applied to the gate of the respective pixel transistor via the gate lines Vg1A through Vg4A. Accordingly, the two step integral precharge system is not applicable.

SUMMARY OF THE INVENTION

A first aspect of the present invention has been carried out in view of the above-described first problem and an it is an object thereof to provide a liquid crystal display apparatus capable of improving failures in image quality such as horizontal cross talk, in-face shading and the like, its driving method and a liquid crystal display system.

In order to achieve the above-described object, according to the first aspect of the present invention, there is provided a liquid crystal display apparatus for successively driving respective pixels arranged in a matrix shape at respective lines in units of the pixels wherein image signals having polarities inverse to each other are inputted, the image signals having the polarities inverse to each other are simultaneously written to the pixels of different ones of the lines and in a pixel arrangement after having written the image signals, the polarities of the pixels constitute the same polarity between contiguous left and right ones of the pixels and inverse polarities between upper and lower ones of the pixels.

By inputting the image signals in the polarities inverse to each other and applying the image signals in the polarities inverse to each other to contiguous ones of signal lines, driving operation similar to that in the case of the dot inversion driving system is carried out. In this case, in the pixel arrangement after having written the image signals, the driving operation is carried out such that the polarities of the pixels are the same polarity between contiguous left and right ones of the pixels and inverse polarities between upper and lower ones of the pixels, whereby the pixel arrangement after having written the image signals are provided with the same polarity between contiguous left and right ones of the pixels similar to the case of the 1H inversion driving system.

Further, a second aspect of the present invention has been carried out in view of the above-described second problem and it is an object thereof to provide a liquid crystal display apparatus capable of realizing precharging operation in two steps even in the case of a graphics display standard of an image format having a short horizontal blanking period and its driving method.

In order to achieve the above-described object, according to the second aspect of the present invention, there is provided a method of driving a liquid crystal display apparatus for successively driving a pixel unit arranged with pixels in a matrix shape for respective rows in units of the pixels, the method comprising the steps of firstly writing a precharge signal at a black level and successively writing a precharge signal at a predetermined level in this order and thereafter writing an image signal for respective signal lines arranged at respective columns of the pixel unit.

According to the active matrix type liquid crystal display apparatus of the dot successive driving system, by writing the precharge signal at the black level and the precharge signal at the predetermined level to respectives of the signal lines, that is, by carrying out the precharging operation in two steps in the dot successive manner prior to writing the image signal, there is no need of carrying out the precharging operation in the horizontal blanking period and accordingly, the second aspect of the present invention is applicable also to an image format having a short horizontal blanking period.

BRIEF DESCRIPTION OF THE DRAWINGS

Preferred Embodiments of the present invention will be described in detail based on the follwings, wherein:

FIG. 21 illustrates timing charts for explaining operation of the other related art.

DETAILED DESCRIPTION OF THE PREFERRED EMBODIMENTS

A detailed explanation will firstly be given as follows of embodiments according to a first aspect of the present invention.

Figure 1:
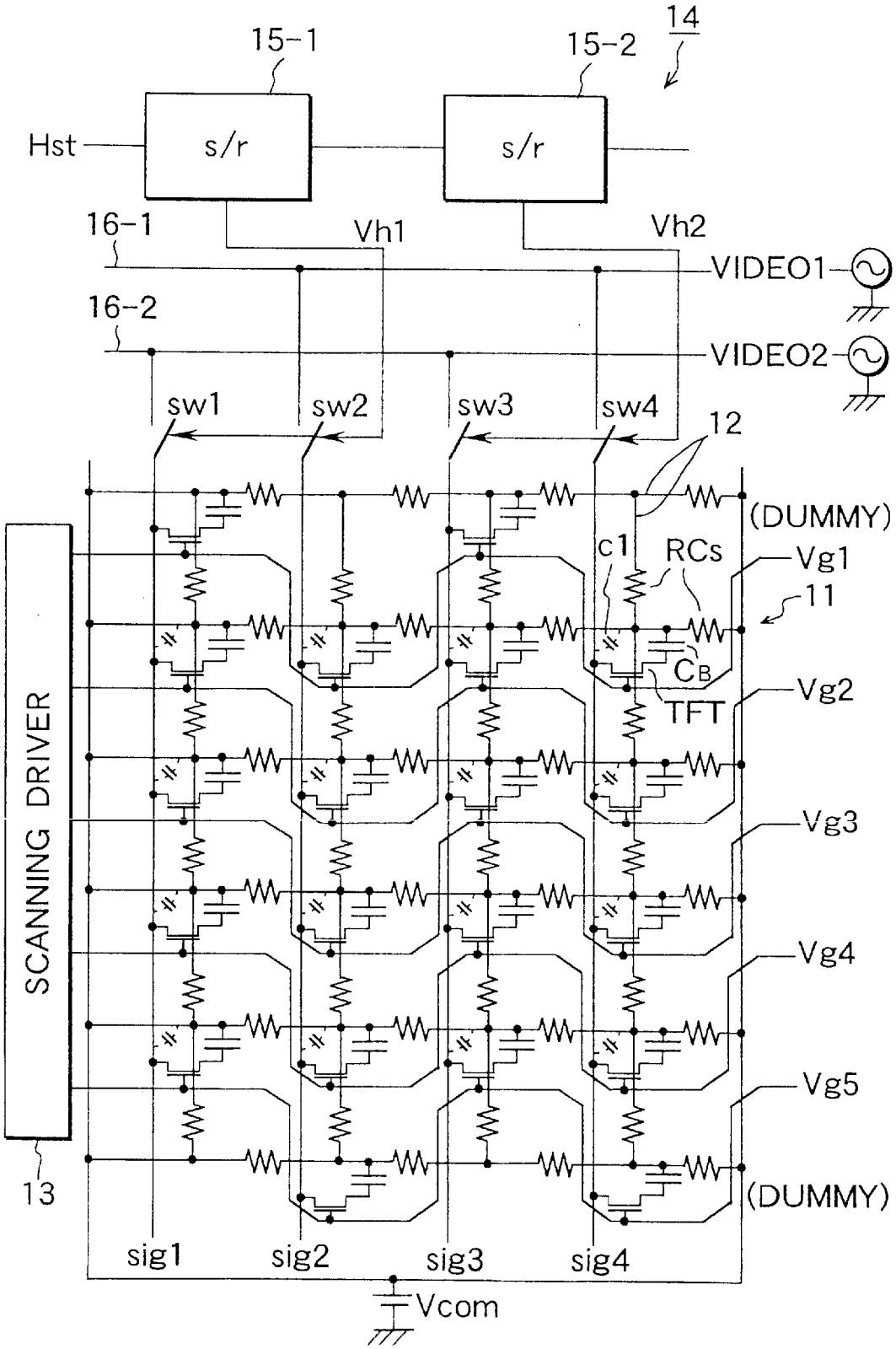
FIG. 1 is a circuit diagram showing a constitution example of an active matrix type TFT liquid crystal display apparatus according to a first embodiment of the present invention.

FIG. 1 is a circuit diagram showing a constitution example of an active matrix type liquid crystal display apparatus according to an embodiment of the present invention. In this case, for simplicity, there is shown a case of an arrangement of six rows and four columns of pixels as an example. Further, in respect of a first row and a six row, there are constituted arrangements of dummy pixels which are arranged at every other column of the pixels and to which image signals are not written but black signals are written.

In FIG. 1, six rows×four columns of pixels 11 are arranged in a matrix shape. However, in respect of the first row, only odd number columns of the pixels are arranged as dummy pixels and in respect of the six row, only even number columns of the pixels are arranged as dummy pixels, respectively. Each of the pixels 11 is constructed by a constitution having a thin film transistor TFT constituting a pixel transistor and a hold capacitor Cs one electrode of which is connected to a drain electrode (or source electrode) of the thin film transistor TFT. Further, in this case, for simplifying the drawing, a liquid crystal cell LC is omitted. A pixel electrode of the liquid crystal cell LC is connected to the drain electrode of the thin film transistor TFT.

With regard to respectives of the pixels 11, signal lines sig1 through sig4 are wired at respective columns along column directions. In the meantime, gate lines Vg1 through Vg5 are wired for respective rows not along row directions thereof but wired to meander, for example, between the pixels 11 of two upper and lower lines (two upper and lower rows). That is, the gate line Vg1 is wired for the respective pixels of a first row and a first column, a second row and a second column, a first row and a third column and a second row and a fourth column. The gate line Vg2 is wired for the respective pixels of a second row and a first column, a third row and a second column, a second row and a third column, and a third row and a fourth column. Also the gate lines Vg3, Vg4 and Vg5 are similarly wired to meander.

In respectives of the pixels 11, source electrodes (or drain electrodes) of the thin film transistors TFT are connected to respectives of the corresponding signal lines sig1 through sig4 and opposed electrodes of the liquid crystal cells LC, not illustrated, and other electrodes of the hold capacitors Cs are connected to the Cs lines 12 commonly among the respective pixels. In this case as is apparent from FIG. 1, the Cs lines 12 are wired in a matrix shape. Further, predetermined direct current voltage is applied as common voltage Vcom to the opposed electrodes of the liquid crystal cells LC, not illustrated, and the other electrodes of the hold capacitors Cs via the Cs lines 12.

Further, a connection relationship with regard to the gate lines Vg1 through Vg5 is as follows. That is, with regard to the odd number columns (first column, third column), gate electrodes of the thin film transistors TFT of the respective pixels are connected to the gate lines Vg1 through Vg5 of corresponding rows for respective rows (first row through fifth row) and with regard to the even number rows (second row, fourth row), the gates of the thin film transistors TFT of the pixels are connected to the gate lines Vg1 through Vg5 of rows of row numbers higher than those of the corresponding rows of the respective rows (second row through sixth row).

According to a pixel unit having the above-described constitution, one end of each of the gate lines Vg1 through Vg5 is connected to an output end of each row of a scanning driver 14 constituting a vertical drive circuit arranged, for example, on the left side of the pixel unit. The scanning driver 13 carries out a processing of successively scanning the gate lines Vg1 through Vg5 at every vertical period (every field period) and selecting the respective pixels 11 connected to the gate lines Vg1 through Vg5 alternately between two upper and lower lines.

That is, when scanning pulses are applied from the scanning driver 13 to the gate line Vg1, the respective pixels of the first row and the first column, the second row and the second column, the first row and the third column, and the second row and the fourth column. When scanning pulses are applied to the gate line Vg1, the respective pixels of the second row and the first column, the third row and the second column, the second row and the third column, and the third row and the fourth column. Similarly, also when scanning pulses are applied to the gate lines Vg3, Vg4 and Vg5, there are selected the pixels alternately between two upper and lower lines.

A source driver 14 constituting a horizontal drive circuit is arranged, for example, on an upper side of the pixel unit. The source driver 14 carries out a processing of successively sampling, for example, image signals video1 and video2 inputted in two routes at every "H" and writing the sampled image signals to the respective pixels 11 selected by the scanning driver 13. As the two routes of the image signals video1 and video2, similar to the dot inversion driving system, there are inputted the image signals having polarities inverted to each other in which the polarities are inverted at every "H" period.

The source driver 14 is constructed by a constitution having shift registers (respective transmitting stages 15-1, 15-2) for outputting sampling pulses Vh1 and Vh2 by successively carrying out shifting operating in response to a horizontal start pulse Hst and sampling switches sw1 through sw4 alternately connected between the respective signal lines sig1 through sig4 of the pixel unit and respective input signal lines 16-2 and 16-1 of the image signals video2 and video1.

According to the source driver 14, the sampling switches sw1 through sw4 are in pairs of twos (sw1 and sw2, sw3 and sw4) and writes the two routes of the image signals video2 and video1 having polarities inverse to each other to the respective signal lines sig1 through sig4 in units of two columns (two pixels) by successively carrying out ON operation in response to the sampling pulses Vh1 and Vh2 successively outputted from the respective transmitting stages 15-1 and 15-2 of the shift registers.

Next, an explanation will be given of driving the active matrix type TFT liquid crystal display apparatus of the dot successive driving system having the above-described constitution in reference to timing charts of FIG. 2. Further, in six rows×four columns of the pixel arrangement, addresses of the respective pixels are attached as shown by FIG. 3. In this case, notation "d" designates the dummy pixel.

First, when a scanning pulse is outputted from the scanning driver 13 to the gate line Vg1 at the first line, the scanning pulse is applied to the gate electrodes of the respective thin film transistors TFT of the pixels d-l, 1-2, d-3 and 1-4 via the gate line Vg1 and accordingly, the pixels d-1, 1-2, d-4 and 1-4 are brought into an ON state.

In this case, similar to the case of the dot inversion driving system, the sampling switches sw1 and sw2 as well as sw3 and sw4 in pairs are successively brought into the ON state by inputting the image signals video1 and video2 having polarities inverse to each other via the input signal lines 16-1 and 16-2 and on the other hand, outputting the sampling pulses Vh1 and Vh2 successively from the respective transmitting stages 15-1 and 15-2 of the shift registers.

Then, the image signals video2 and video1 having polarities inverse to each other are firstly applied to the signal lines sig1 and sig2 via the sampling switches sw1 and sw2. Thereby, the image signal video2 having a negative polarity (designated by "−" in FIG. 3) is written to the pixel d-1 and the image signal video1 having a positive polarity (designated by "+" in FIG. 3) is written to the pixel 1-2, respectively. However, as the image signal video2 at this occasion, a black signal is inputted and the black signal is inputted to the dummy pixel d-1.

Successively, the image signals video2 and video1 are provided to the signal lines sig3 and sig4 via the sampling switches sw3 and sw4. Thereby, the image signal video2 having the negative polarity is written to the pixel d-3 and the image signal video1 having the positive polarity is written to the pixel 1-4, respectively. Also in this case, the black signal is written to the dummy pixel d-3 by inputting the black signal as the image signal video2.

Next, at the second line, when a scanning pulse is outputted from the scanning driver 13 to the gate line Vg2, the scanning pulse is applied to the gate electrodes of the respective thin film transistors TFT of the pixels 1-1, 2-2, 1-3 and 2-4 via the gate line Vg2 and accordingly, the pixels 1-1, 2-2, 1-3 and 2-4 are brought into the ON state.

At the second line, the respective polarities of the image signals video1 and video2 are inverted. That is, although at the first line, the image signal video1 is in the positive polarity and the image signal video2 is in the negative polarity, at the second line, the image signal video1 is in the negative polarity and the image signal video2 is in the positive polarity. Further, at the source driver 16, the sampling pulses Vh1 and Vh2 are again outputted successively from the respective transmitting stages 15-1 and 15-2 of the shift registers to thereby bring the sampling switches sw1 and sw2 as well as sw3 and sw4 in pairs successively into the ON state.

Then, the image signals video2 and video1 having polarities inverse to each other are applied to the signal lines sig1 and sig2 via the sampling switches sw1 and sw2. Thereby, the image signal video2 having the positive polarity is written to the pixel 1-1 and the image signal video1 having the negative polarity is written to the pixel 2-2, respectively. Successively, the video signals video2 and video1 are applied to the signal lines sig3 and sig4 via the sampling switches sw3 and sw4. Thereby, the image signal video2 having the positive polarity is written to the pixel 1-3 and the image signal video1 having the negative polarity is written to the pixel 2-4, respectively.

Thereafter, while the image signals video2 and video1 having polarities inverse to each other are inputted by inverting the polarities at every "H", the above-described operation is repeated to thereby carry out scanning in the vertical direction (row direction) by the scanning driver 13 and scanning in the horizontal direction (column direction) by the source driver 14. Further, in the case of scanning the gate line Vg5, the black signal is inputted as the image signal Video1 and the black signal is written to the dummy pixels d-2 and d-4.

Figures 2, 3:
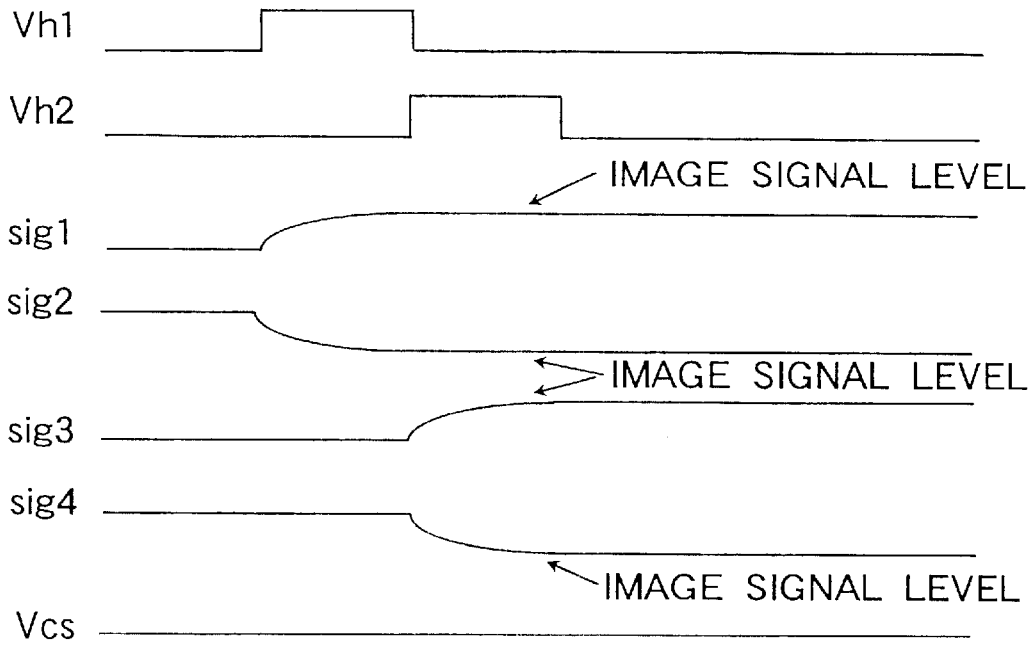
FIG. 2 is a waveform diagram for explaining operation of dot-line inversion driving.
FIG. 3 shows addresses of respective pixels and polarities of image signals written to the respective pixels in the case of the dot-line inversion driving.

As has been described above, according to the active matrix type TFT liquid crystal apparatus, there is carried out a so-to-speak dot-line inversion driving in which while, for example, the two routes of the image signals video1 and video2 are inputted in inverse polarities, the image signals video1 and video2 having the inverse polarities are simultaneously written to the pixels of different lines (in this example, two upper and lower lines) and as shown by FIG. 3, in the pixel arrangement after the writing operation, the polarities of the pixels are in the same polarity in respective of contiguous left and right ones of the pixels and in the inverse polarities in respect of the upper and lower rows of the pixels.

By the dot-line inversion driving, as is apparent from timing charts of FIG. 2, the sampling pulses Vh1 and Vh2 are successively outputted and the sampling switches sw1 and sw2 as well as sw3 and sw4 are successively brought into the ON state, then, similar to the case of the dot inversion driving system, the image signals video2 and video1 having the inverse polarities are applied to the signal lines sig1 and sig2 as well as sig3 and sig4 and accordingly, there can be improved failures in image quality such as horizontal cross talk, in-face shading, vertical cross talk and so on.

That is, in inputting the image signals video1 and video2 to the Cs lines 12 via the parasitic capacitances c1 and the hold capacitors Cs and the like present between the signal lines sig1 through sig4 or Cs lines 12, the deviation owing to the presence of the resistor components RCs in the Cs lines 12, can be canceled by providing the image signals video1 and video2 having polarities inverse to each other to contiguous ones of the signal lines and accordingly, there causes no deviation of potential VCs of the Cs line 12 and accordingly, production of horizontal cross talk can be restrained and the failure in shading can be resolved.

Further, in inputting the deviation ΔVsig of potential of the signal lines sig1 through sig4 at every "H" to the pixels by source/drain couplings of the thin film transistors TFT owing to the parasitic capacitances present between the source/drain electrodes of the thin film transistors TFT and the respectives of the signal lines sig1 through sig4, the deviation can be canceled by providing the image signals video1 and video2 having polarities inverse to each other to contiguous ones of the signal lines and accordingly, production of vertical cross talk can be restrained. Thereby, the video signals video1 and video2 can be written with sufficient levels and accordingly, the contrast can be promoted.

Figures 12, 13:
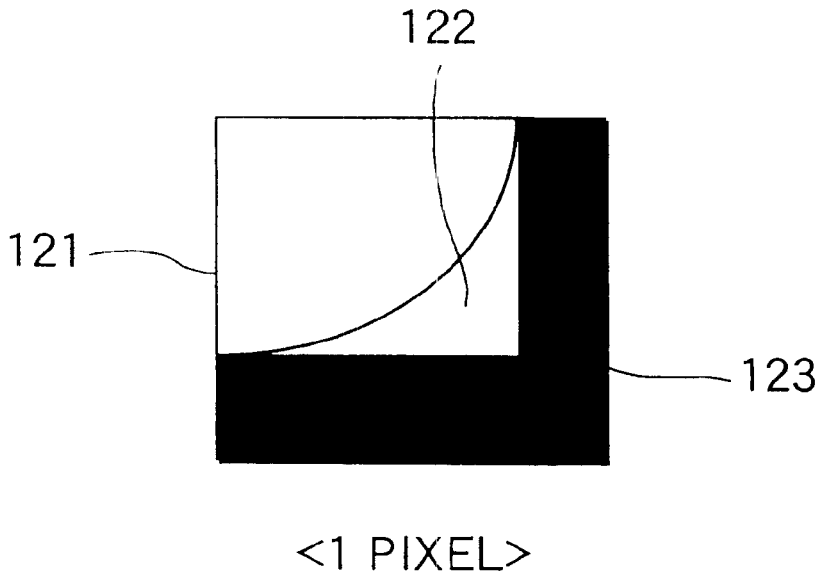
FIG. 12 shows polarities of image signals written to respective pixels by the dot inversion driving.
FIG. 13 shows a behavior of producing a domain of a pixel in the dot inversion driving.

Further, by writing the image signals video1 and video2 having polarities inverse to each other to the pixels not on one horizontal line as in the case of the dot inversion driving system but at every pixel (at every column) between different horizontal lines (in this example, two upper and lower lines), according to the polarity of the pixel arrangement, as is apparent from FIG. 3, similar to the case of the 1H inversion driving system, contiguous left and right pixels are in the same polarity and accordingly, the domain which is problematic in the case of the dot inversion driving system (refer to FIG. 13) is not caused. Thereby, the aperture rate of the pixel may not be lowered.

Further, although according to the above-described embodiment, the two routes of the image signals video1 and video2 are inputted as the image signals, a number of the input is not limited to that of the two routes but may be that of 2n (notation "n" designates an integer) routes. Further, although the image signals video1 and video2 having polarities inverse to each other are simultaneously written to the pixels of two upper and lower lines, it is not necessary that the pixels are necessarily those of the two upper and lower lines, in sum, the image signals may simultaneously be written to the pixels of different horizontal lines such that in the pixel arrangement after the writing operation, according to the polarity of the pixel, the same polarity is provided to contiguous left and right ones of the pixels and inverse polarities may be provided to upper and lower ones of the pixels.

Further, although an explanation has been given of the above-described embodiment, in the case in which the present invention is applied to the liquid crystal display apparatus mounted with an analog interface drive circuit for driving the respective pixels in the dot successive manner by inputting and sampling the analog image signal, the present invention is similarly applicable to a liquid crystal display apparatus mounted with a digital interface drive circuit for driving the respective pixels in the dot successive manner by inputting digital image signals, latching the digital image signals, inverting the digital image signals into analog image signals and sampling the analog image signals.

Next, an explanation will be given of a liquid crystal display system according to the present invention using an active matrix type TFT liquid crystal display apparatus of a dot successive driving system having the above-described constitution.

Figure 4:
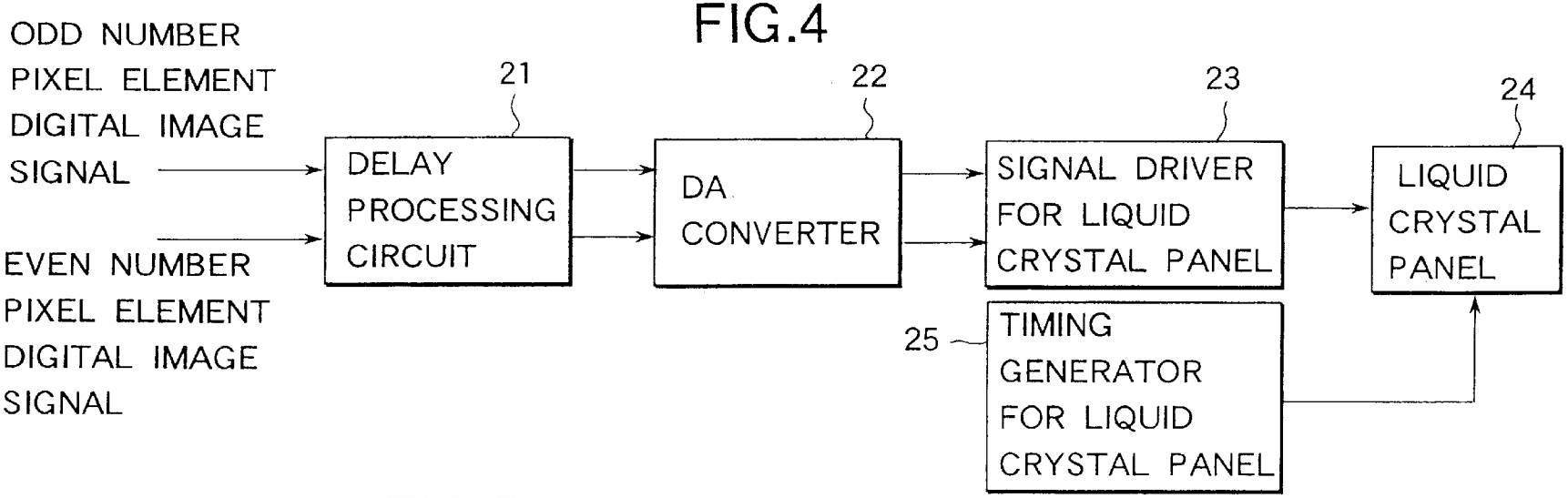
FIG. 4 is a block diagram showing an example of a constitution of a liquid crystal display system according to a first aspect of the present invention.

FIG. 4 is a block diagram showing an example of a constitution of a liquid crystal display system according to the present invention. The liquid crystal display system is constructed by a constitution having a delay processing circuit 21, a DA converter 22, a signal driver 23 for a liquid crystal panel, a liquid crystal panel 24 and a timing generator 25 for the liquid crystal panel and using an active matrix type TFT liquid crystal display apparatus of the dot-line inversion driving system according to the present invention, described above.

The delay processing circuit 21 is inputted with two of digital image signals of the odd number pixels and digital image signals of the even number pixels and outputs either one of the digital image signals by delaying the digital image signals by a time period in correspondence with one line. The DA converter 22 subjects the digital image signals of the odd number pixels and the digital image signals of the even number pixels having time shift in correspondence with the one line respectively to DA conversion and supplies analog image signals of the odd number pixels and analog image signals of the even number pixels to the signal driver 23 for the liquid crystal panel.

The signal driver 23 for the liquid crystal panel carries out display driving for the respective pixels of the liquid crystal panel 24 based on the analog image signal of the odd number pixels and the analog image signals of the even number pixels having the time shift in correspondence with the one line. The liquid crystal panel 24 carries out control of horizontal scanning, vertical scanning or the like and writes the image signals to the respective pixels based on various kinds of timing signals of horizontal and vertical start pulses and horizontal and vertical clocks provided from the timing generator 25 for the liquid crystal panel.

Here, consider an example of a case of using the active matrix type TFT liquid crystal display apparatus of the dot successive driving system shown by FIG. 1, that is, the active matrix type TFT liquid crystal display apparatus of the dot-line inversion driving system. In the case of writing the image signals to the respective pixels of the first row excluding the arrangements of the dummy pixels (pixels 1-1, 1-2, 1-3, 1-4 of FIG. 3), although the gate lines Vg1 and Vg2 which are wired to meander are connected to the pixels 1-1, 1-2, 1-3 and 1-4, the image signals in the same one H period need to write to the pixels.

However, as is apparent from the above-described explanation of the operation, by connecting the gate lines Vg1 and Vg2 which are wired to meander to the pixels 1-1, 1-2, 1-3 and 1-4, the image signals delayed by one line relative to the even number pixels 1-2 and 1-4 are written to the odd number pixels 1-2 and 1-3. Accordingly, in the case of this example, by delaying the image signals of the even number pixels by the time period in correspondence with the one line relative to the image signals of the odd number pixels at the delay processing circuit 21, the image signals in the same 1H period can be written to the respective pixels 1-1, 1-2, 1-3 and 1-4 of the first row.

Figure 5:
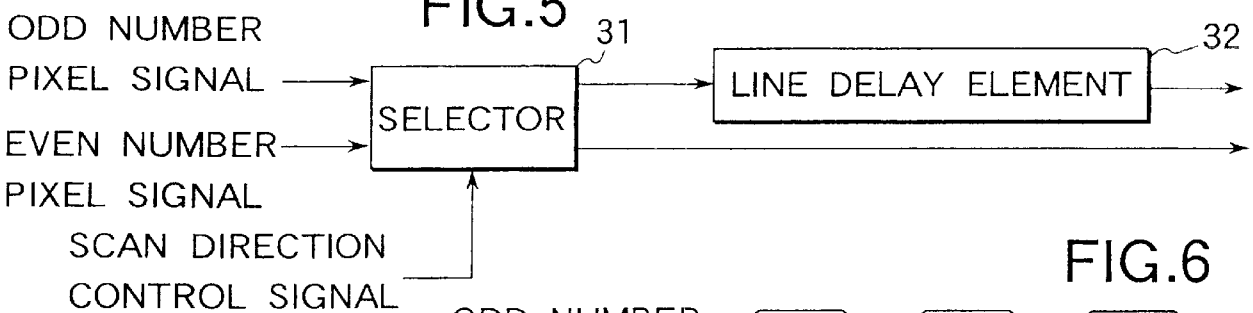
FIG. 5 is a block diagram showing an example of specific constitution of a delay processing circuit.

FIG. 5 is a block diagram showing an example of a specific constitution of the delay processing circuit 21. The delay processing circuit 21 according to the example is constructed by a constitution having a selector 31 for inputting two of the digital image signals of the odd number pixels and the digital image signals of the even number pixels and selecting to output the digital image signals of the odd number pixels from a side of an output end "a" thereof and output the digital image signals of the even number pixels from a side of an output end "b" or to output the digital image signals of the odd number pixels from the side of the output end "b" and output the digital image signals of the even number pixels from the side of the output end "a" in accordance with scan direction control signals, and a one line delay element 32 for delaying the image signals outputted from the output end "a" of the selector 31 by the time period in correspondence with the one line.

In the case of the above-described example, the selector 31 outputs the digital image signals of the even number pixels from the side of the output end "a" and outputs the digital image signals of the odd number pixels from the side of the output end "b". In this case, the digital image signal of the even number pixels are outputted via the one line delay element 32 and the digital image signal of the odd number pixels are directly outputted therefrom without passing through the one line delay element 32.

However, which one of the digital image signals of the even number pixels and the digital image signals of the odd number pixels is to be delayed, is dependent on structure layout of the liquid crystal panel 24 and the horizontal and the vertical scan directions. Accordingly, the selector 31 carries out the switching operation in accordance with the scan directions. When the scan directions are directions inverse to those of the above-described example, the selector 31 outputs the digital image signals of the odd number pixels from the side of the output end "a" and outputs the digital image signals of the even number pixels from the side of the output end "b". A line memory or the like is used for the one line delay element 32.

Figure 6:
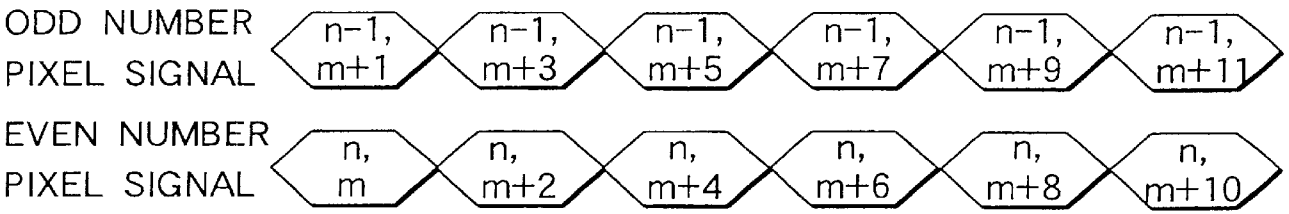
FIG. 6 illustrates timing charts showing a relationship between a digital image signal of an odd number pixel and a digital image signal of an even number pixel when the digital image signal of the odd number pixel is delayed.
Figure 7:
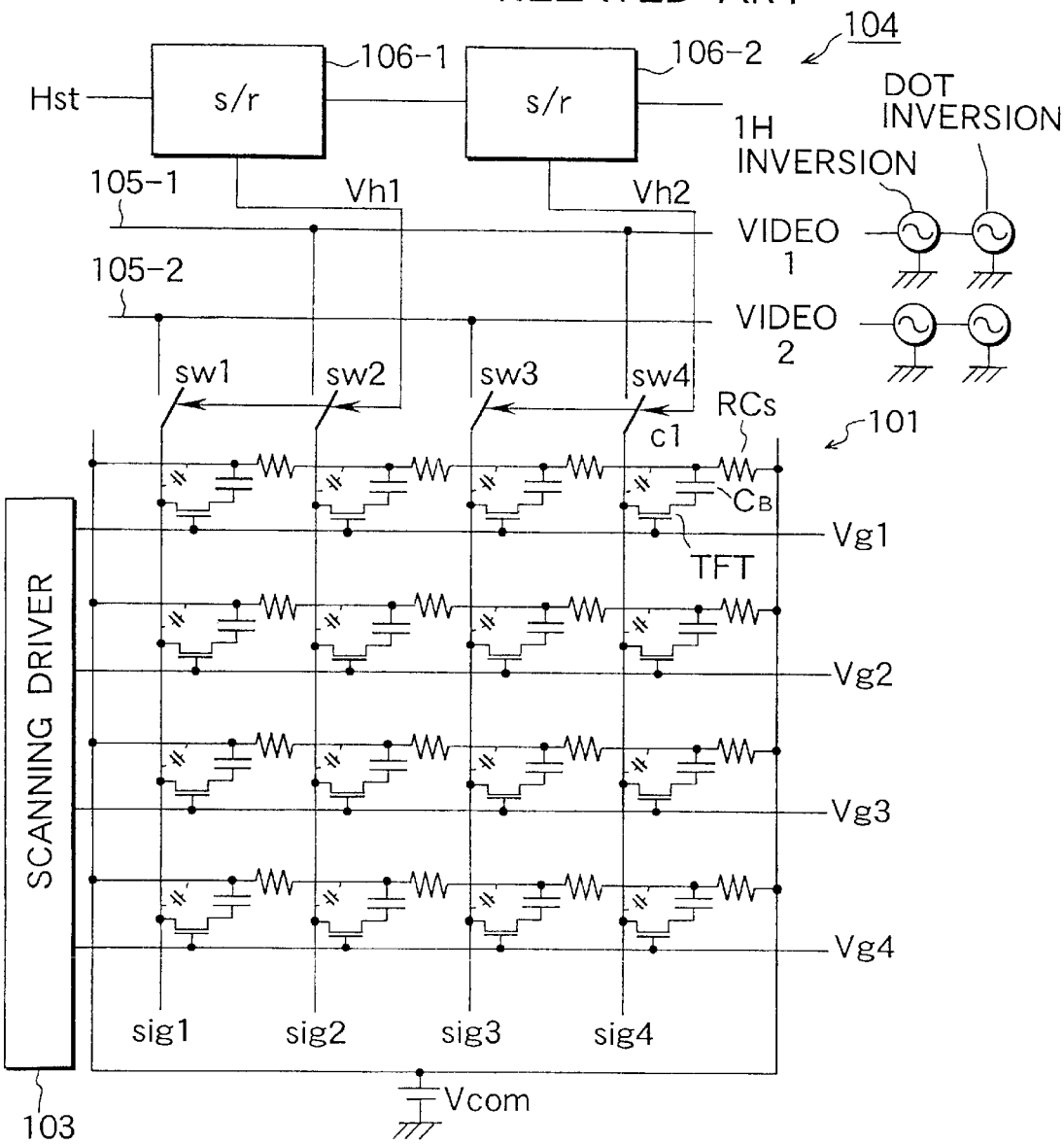
FIG.7 RELATED ART
FIG. 7 is a constitution diagram showing a related art of an active matrix type liquid crystal display apparatus.
Figure 8:
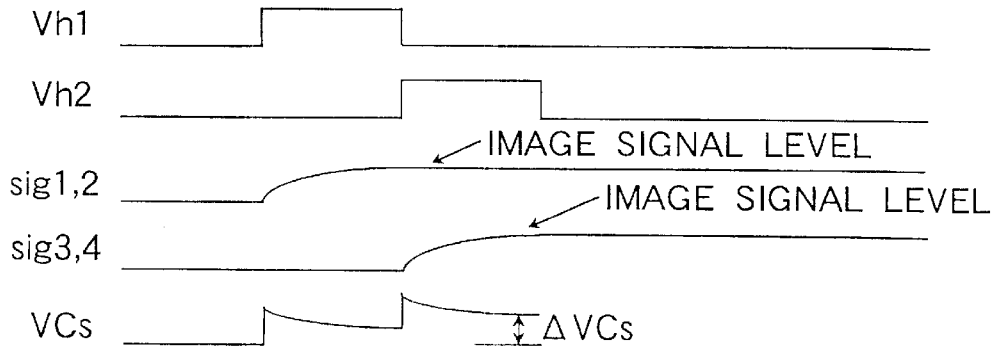
FIG. 8 is a waveform diagram for explaining operation of 1H inversion driving.
Figure 9:
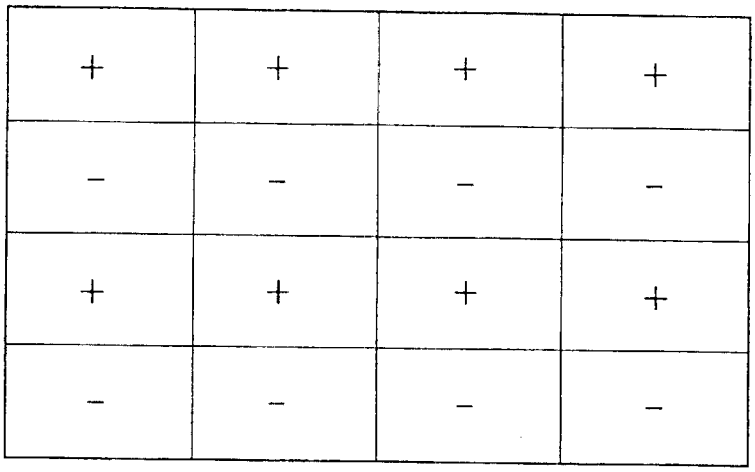
FIG. 9 shows polarities of image signals written to respective pixels by the 1H inversion driving.
Figure 10:
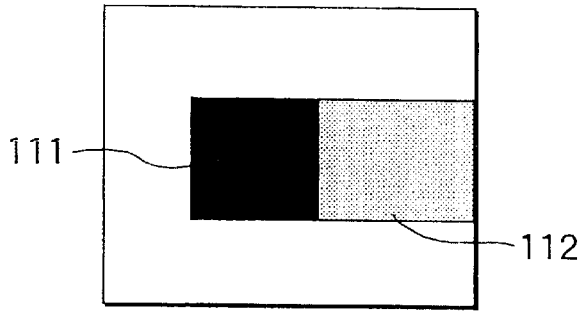
FIG. 10 explains cause of producing horizontal cross talk.
Figure 11:
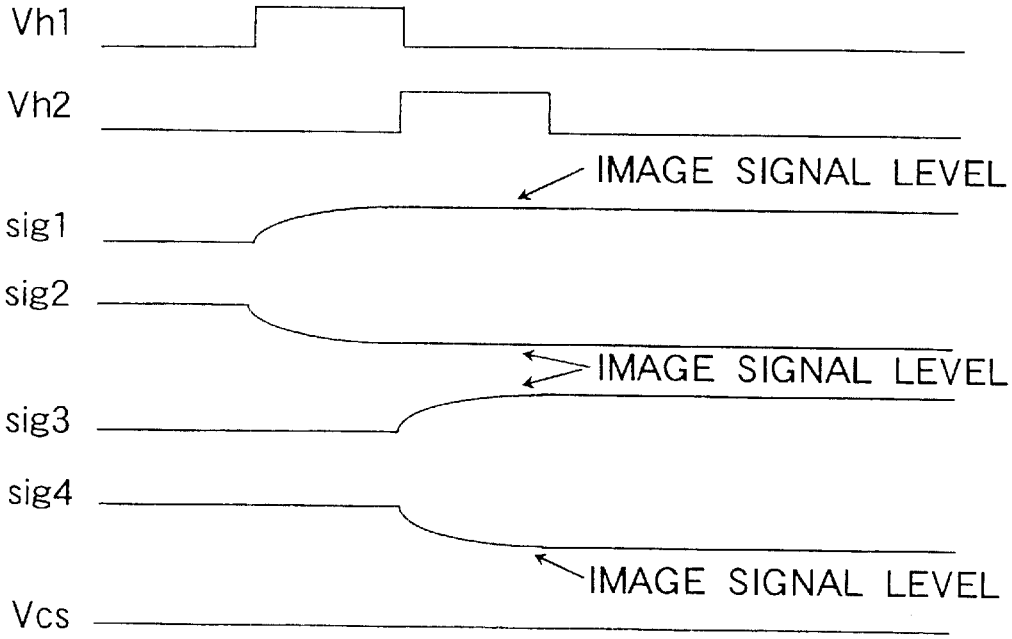
FIG. 11 is a waveform diagram for explaining operation of dot inversion driving.

FIG. 6 shows a timing relationship between the digital image signals of the odd number pixels and the digital image signals of the even number pixels when the digital image signals of the odd number pixels are delayed. In this case, notation "n" designates a vertical line number and notation "m" designates a horizontal pixel number, respectively. It is known from the timing chart of FIG. 6 that signals of the vertical line number (n-1) are outputted as the digital image signal of the odd number pixels and signals of the vertical line number "n" are outputted as the digital image signals of the even number pixels and the digital image signals of the odd number pixels are delayed by the time period in correspondence with the one line relative to the digital image signals of the even number pixels.

In this way, even in the case of the active matrix type TFT liquid crystal display apparatus of the dot-line inversion driving, that is, in the case of the liquid crystal display apparatus of the driving system in which, for example, the image signals video1 and video2 having polarities inverse to each other of the two routes are simultaneously written to the pixels of different horizontal lines and with regard to the polarity of the pixel in the pixel arrangement after the writing operation, contiguous left and right ones of the pixels are in the same polarity and upper and lower ones of the pixels are in the inverse polarities, the signals to be delayed by the time period in correspondence with the one line can be selected to be the digital image signals of the even number pixels or the digital image signals of the odd number pixels in accordance with the scan directions to thereby enable to easily deal with even the change of the scan directions.

Further, although in this case, the delay element 32 delays the signals by the time period in correspondence with the one line by taking an example of the case in which the present invention is applied to the liquid crystal display apparatus having the constitution in which the image signals video1 and video2 having polarities inverse to each other are simultaneously written to the pixels of two upper and lower lines (two upper and lower rows), in the case of applying the present invention to a liquid crystal display apparatus having a constitution in which the image signals are simultaneously written to the pixels of different lines separated from each other by two lines or more, the delay element 32 may delay the signals by a time period in correspondence with a number of lines of the separation.

As has been explained, according to the first aspect of the present invention, in the active matrix type liquid crystal display apparatus of the successive driving system, by simultaneously writing the image signals having polarities inverse to each other to the pixels of different lines and making the polarities of the pixels in the pixel arrangement after the writing operation to be the same polarity in respect of contiguous left and right ones of the pixels and inverse polarities in respect of upper and lower ones of the pixels, similar to the dot inversion driving system, the image signals having polarities inverse to each other are provided to contiguous signal lines, further, similar to the case of the 1H inversion driving system, the polarities of the pixels of the arrangement after writing the image signals are in the same polarity in respect of left and right contiguous ones of the pixels and accordingly, failures in image quality such as horizontal cross talk, in-face shading and so on can be improved without lowering the aperture rate of the pixel.

Figure 14:
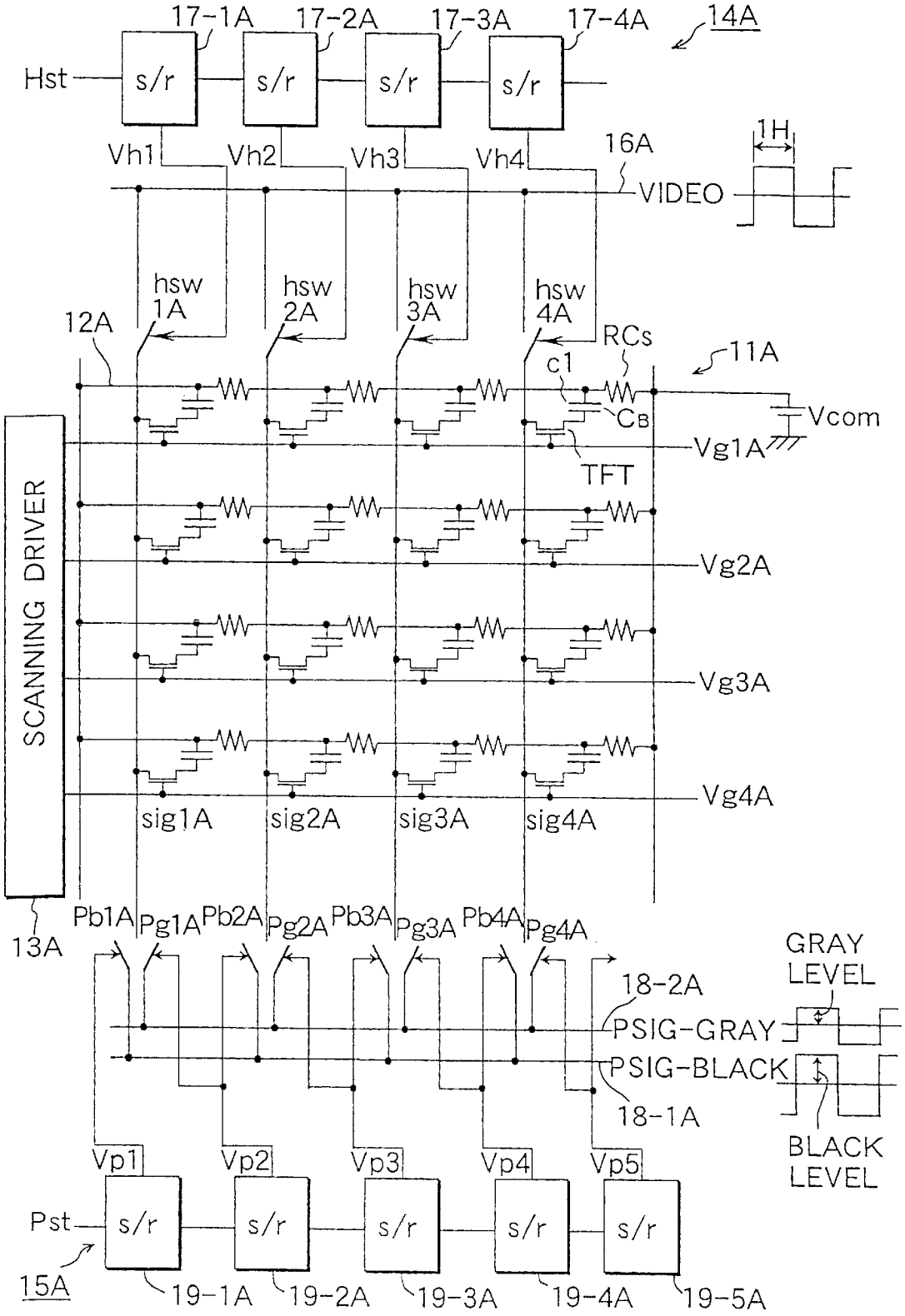
FIG. 14 is a circuit diagram showing a constitution example of an active matrix type liquid crystal display apparatus of a dot successive driving system according to a first embodiment of a second aspect of the present invention.

A detailed explanation will be given as follows of an embodiment according to a second aspect of the present invention in reference to the drawings. FIG. 14 is a circuit diagram showing a constitution example of an active matrix type liquid crystal display apparatus of the dot successive driving system according to a first embodiment of the second aspect of the present invention. In this case, for simplicity, there is shown, as an example, the case of an arrangement of four rows and four columns of pixels.

In FIG. 14, pixels 11A are arranged in a matrix shape at intersecting portions of respectives of gate lines Vg1A through Vg4A and respectives of signal lines sig1A through sig4A. The pixels 11A are constructed by a constitution having thin film transistors TFTs gate electrodes of which are connected to the gate lines Vg1A through Vg4A and source electrodes (or drain electrode) of which are connected to the signal lines sig1A through sig4A, respectively, and the hold capacitors Cs one electrode of each of which is connected to the drain electrode (or source electrode) of the thin film transistor TFT.

Further, in this case, for simplifying the drawings, the liquid crystal cell LC is omitted. A pixel electrode of the liquid crystal cell LC is connected to the drain electrode of the thin film transistor TFT.

According to the pixel structure, the opposed electrodes of the liquid crystal cells LC, not illustrated, and the other electrodes of the hold capacitors Cs are connected to Cs lines 12A commonly among the respective pixels. Further, predetermined direct current voltage is provided to the opposed electrodes of the liquid crystal cells LC, not illustrated, and the other electrodes of the hold capacitors Cs via the Cs lines 12A. Further, the Cs line 12A is provided with the resistor components RCs between contiguous left and right ones of the respective pixels.

A scanning driver 13A is arranged, for example, on the left side of a pixel unit. The scanning driver 13A carries out a processing of selecting the pixels 11A in units of rows by successively scanning the gate lines Vg1A through Vg4A at every field period. Further, a source driver 14A is arranged, for example, on the upper side of the pixel unit and a precharge driver 15A is arranged, for example, on the lower side of the pixel unit, respectively.

The source driver 14A carries out a processing of successively sampling an image signal video inputted via an image signal line 16A and having polarities inverted at every "H" and writing the image signal to the pixels 11A of a row selected by the scanning driver 13A. That is, sampling switches hsw1A through hsw4A connected between the respective signal lines sig1A through sig4A of the pixel unit and the image signal line 16A, are successively made ON in response to the sampling pulses Vh1 through Vh4 successively outputted from the respective transmitting stages 17-1A through 17-4A of shift registers.

The precharge driver 15A carries out a processing of successively sampling a precharge signal Psig-black at the black level and a precharge signal Psig-gray at, for example, gray level inputted via precharge signal lines 18-1A and 18-2A in polarities the same as the polarity of the image signal video and writing the sampled precharged signals to the pixels 11A of a row selected by the scanning driver 13A prior to the image signal video.

According to the precharge driver 15A, sampling switches Pb1A through Pb4A are connected between respectives of the signal lines sig1A through sig4A and the precharge signal line 18-1A and sampling switches Pg1A through Pg4A are connected between respectives of the signal lines sig1A through sig4A and the precharge signal line 18-2A, respectively. Further, the sampling switches Pb1A through Pb4A and Pg1A through Pg4A are successively made ON in response to the sampling pulses Vp1 through Vp5 successively outputted from respective transmitting stages 19-1A through 19-5A of shift registers.

That is, the sampling switches Pb1A through Pb4A are provided with the sampling pulses Vp1 through Vp4 successively outputted from the respective transmitting stages 19-1A through 19-4A of the shift registers and the sampling switches Pg1A through Pg4A are provided with the sampling pulses Vp2 through Vp5 successively outputted from the respective transmitting stages 19-2A through 19-5A of the shift registers.

Figure 15:
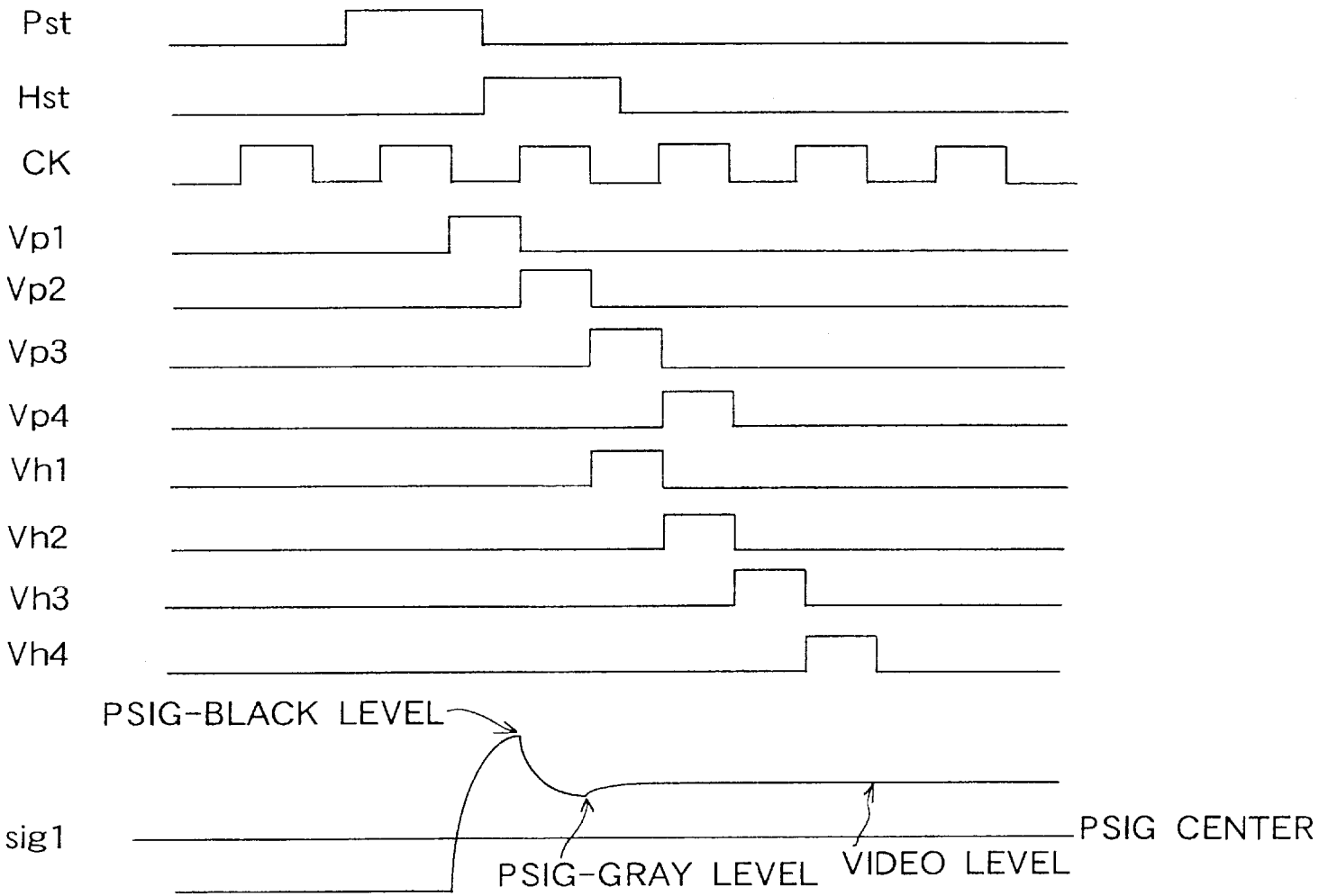
FIG. 15 illustrates timing charts for explaining operation of the first embodiment according to the second aspect of the present invention.

Next, an explanation will be given of operation of the active matrix type TFT liquid crystal display apparatus of the dot successive precharge system having the above-described constitution in reference to timing charts of FIG. 15.

First, the sampling pulses Vp1 through Vp4 are successively outputted in synchronism with the horizontal clock CK in response to the precharge start pulse Pst from the respective transmitting stages 19-1A through 19-4A of the shift registers in the precharge driver 15-A. In the meantime, the sampling pulses Vh1 through Vh4 are successively outputted in synchronism with the horizontal clock CK from the respective transmitting stages 17-1A through 17-4A of the shift registers in the source driver 14A in response to the horizontal start pulse Hst while being delayed by one clock of the horizontal clock CK relative to the sampling pulses Vp1A through Vp4A.

Further, when the first row is selected by the scanning driver 13A, firstly, by making ON the sampling switch Pb1A in response to the sampling pulse Vp1, the precharge signal Psig-black at the black level is written to the signal line sig1A, successively, by making ON the sampling switch Pg1A in response to the sampling pulse Vp1, the precharge signal Psig-gray at the gray level is written to the signal line sig1A. Simultaneously therewith, the sampling switch Pb2A is also made ON in response to the sampling pulse Vp2 and therefore, the precharge signal Psig-black at the black level is written to the signal line sig2A.

Thereafter, when the sampling pulse Vh1 is produced by a timing of producing the sampling pulse Vp3, by making ON the sampling switch hsw1A in response to the sampling pulse Vh1, the image signal video is written to the signal line sig1A. Thereafter, similarly, the precharge signal Psig-black at the black level and the precharge signal Psig-gray are precharged in the dot successive manner in two steps to respectives of the signal lines sig2A, sig3A and sig4A and thereafter, the image signal level video is written thereto in the dot successive manner.

Further, although in this case, an explanation has been given of the operation in the case of carrying out precharging operation in two steps and writing operation of the image signals video in the dot successive manner in respect of the first row (first line), the precharging operation in two steps and the writing operation of the image signal video are carried out in the dot successive manner also in respect of the second row, the third row and the fourth row quite similar to the case of the first row.

As described above, according to the active matrix type TFT liquid crystal display apparatus, by precharging the precharge signal Psig-black at the black level and the precharge signal Psig-gray at the gray level in the dot successive manner in two steps in respectives of the signal lines sig1A through sig4A prior to writing the image signal video to respectives of the signal lines sig1A through sig4A, both of the vertical cross talk and the vertical streak can be eliminated.

That is, by firstly precharging the precharge signal Psig-black at the black level, leakage current between the source and the drain of the pixel transistor can be made uniform over an entire face and accordingly, the vertical cross talk produced owing to the leakage current can be eliminated. Further, thereafter, by precharging the precharge signal Psig-gray at the gray level, charge/discharge current in writing the image signal video can be restrained and accordingly, the vertical streak produced owing to the charge/discharge current can be eliminated.

Further, the precharging operation in two steps is not integrally carried out in the horizontal blanking period but the precharging operation in two steps are carried out also in the dot successive manner prior to writing the image signal video in the dot successive manner to respectives of the signal lines sig1A through sig4A and accordingly, even in the case of an image format having a short horizontal blanking period, the precharging operation needs not to carry out in the horizontal blanking period and accordingly, both of the vertical cross talk and the vertical streak can be eliminated. Therefore, failures in image quality caused by the vertical cross talk and the vertical streak can be improved even in a liquid crystal display apparatus of a number of pixels in accordance with high resolution formation, for example, a liquid crystal display apparatus of the UXGA display standard, HD (high vision) or the like.

Figure 16:
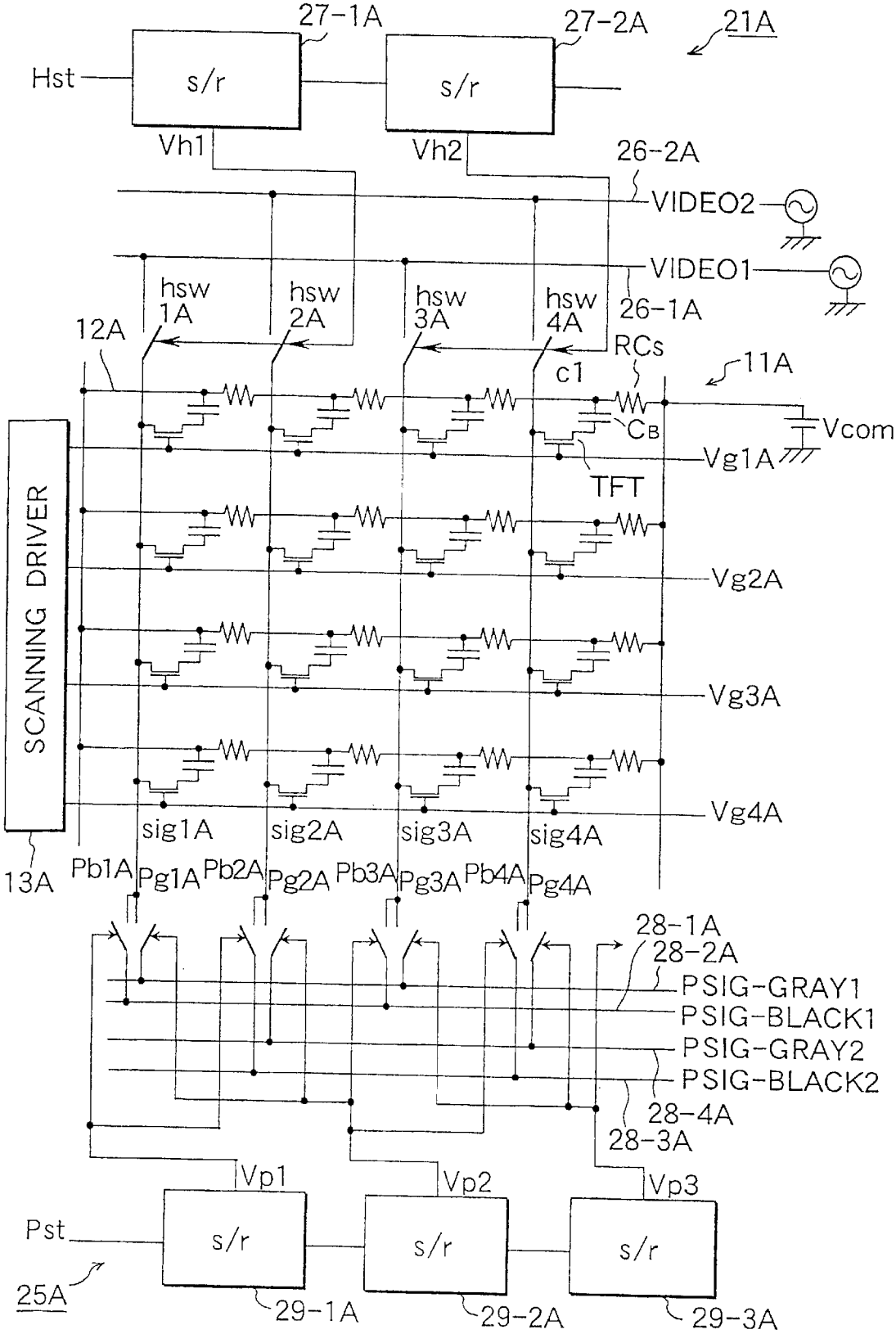
FIG. 16 is a circuit diagram showing a constitution example of an active matrix type liquid crystal display apparatus of the dot successive driving system according to a second embodiment of the second aspect of the present invention.

FIG. 16 is a circuit diagram showing a constitution example of an active matrix type TFT liquid crystal display apparatus of the dot successive driving system according to a second embodiment of the second aspect of the present invention. The active matrix type TFT liquid crystal display apparatus according to the embodiment is a TFT liquid crystal display apparatus of the dot inversion driving system in which polarities of image signals applied to upper and lower and left and right pixels contiguous to each other are alternately inverted.

In this case, for simplicity, similar to the case of the first embodiment, there is shown an example of a case of an arrangement of four rows and four columns of pixels. Further, according to the constitution of a pixel unit, the constitution is quite the same as that in the case of the TFT liquid crystal display apparatus according to the first embodiment and the constitution differs therefrom only in constitutions of a source driver 24A and a precharge driver 25A and accordingly, an explanation will be given of only the constitutions of the different portions as follows.

The source driver 24A carries out a processing of successively sampling, for example, the image signals video1 and video2 of the two routes inputted in polarities inverse to each other and writing the sampled image signals to respective pixels 11A selected by the scanning driver 13A. In this case, polarities of the two routes of the image signals video1 and video2 are inverse to each other and the polarities are inverted at every "H".

The source driver 24A is constructed by a constitution having the sampling switches hsw1A through hsw4A alternately connected between respectives of the signal lines sig1A through sig4A of the pixel unit and respectives of image signals lines 26-1A and 26-2A for inputting the image signals video1 and video2, and shift registers (respective transmitting stages 27-1A and 27-2A) successively outputting the sampling pulses Vh1 and Vh2 and applying the sampling pulses to the sampling switches hsw1A through hsw4A in response to the horizontal start pulse Hst.

According to the source driver 24A, the sampling switches hsw1A through hsw4A are constituted in pairs of twos (hsw1A and hsw2A, hsw3A and hsw4A), by carrying out successively ON operation in response to the sampling pulses Vh1A and Vh2A successively outputted from the respective transmitting stages 27-1A and 27-2A of the shift registers, the two routes of the image signals video1 and video2 having polarities inverse to each other, are written to the respective signal lines sig1A through sig4A in units of two rows (horizontal two pixels).

The precharge driver 25A carries out a processing in which prior to writing the image signals video1 and video2 having polarities inverse to each other to the signal lines sig1A through sig4A, a precharge signal Psig-black1 at the black level and a precharge signal Psig-gray1 inputted in polarities the same as those of the image signal video1, and a precharge signal Psig-black2 at the black level and the precharge signal Psig-gray2 at the gray level inputted in polarities the same as those of the image signal video2, are written to the signal lines sig1A through sig4A.

According to the precharge driver 25A, sampling switches Pb1A and Pb3A are connected between the signal lines sig1A and sig3A and a precharge signal line 28-1A for inputting the precharge signal Psig-black1, and sampling switches Pg1A and Pg3A are connected between the signal lines sig1A and sig3A and a precharge signal line 28-2A for inputting the precharge signal Psig-gray1, respectively. Further, sampling switches Pb2A and Pb4A are connected between the signal lines sig2A and sig4A and a precharge signal line 28-3A for inputting the precharge signal Psig-black2, and sampling switches Pg2A and Pg4A are connected between the signal lines sig2A and sig4A and a precharge signal line 28-4A for inputting the precharge signal Psig-gray2, respectively.

Further, the sampling switches Pb1A through Pb4A and Pg1A through Pg4A are successively made ON in response to the sampling pulses Vp1 through Vp3 successively outputted from respective transmitting stages 29-1A through 29-3A of the shift registers. That is, the sampling pulse Vp1 outputted from the transmitting stage 29-1A is commonly provided to the precharge switches Pb1A and Pb2A and the sampling pulse Vp2 outputted from the transmitting stage 29-2A is commonly provided to the precharge switches Pb3A and Pb4A. Further, the sampling pulse Vp2 outputted from the transmitting stage 29-2A is commonly applied to the precharge switches Pg1A and Pg2A and the sampling pulse Vp3 outputted from the transmitting stage 29-3A is commonly applied to the precharge switches Pg3A and Pg4A.

Figure 17:
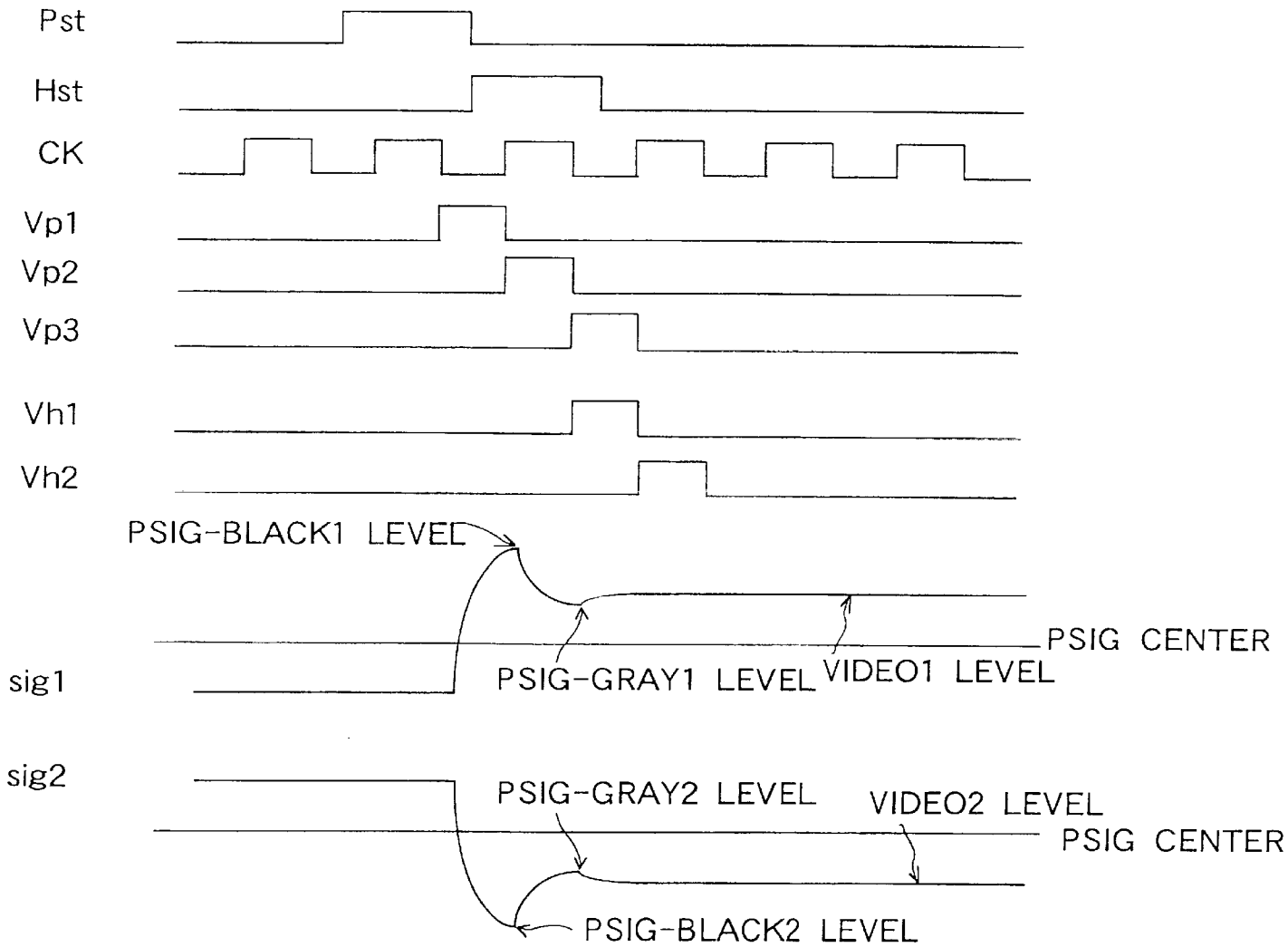
FIG. 17 illustrates timing charts for explaining operation of the second embodiment according to the second aspect of the present invention.
Figure 18:
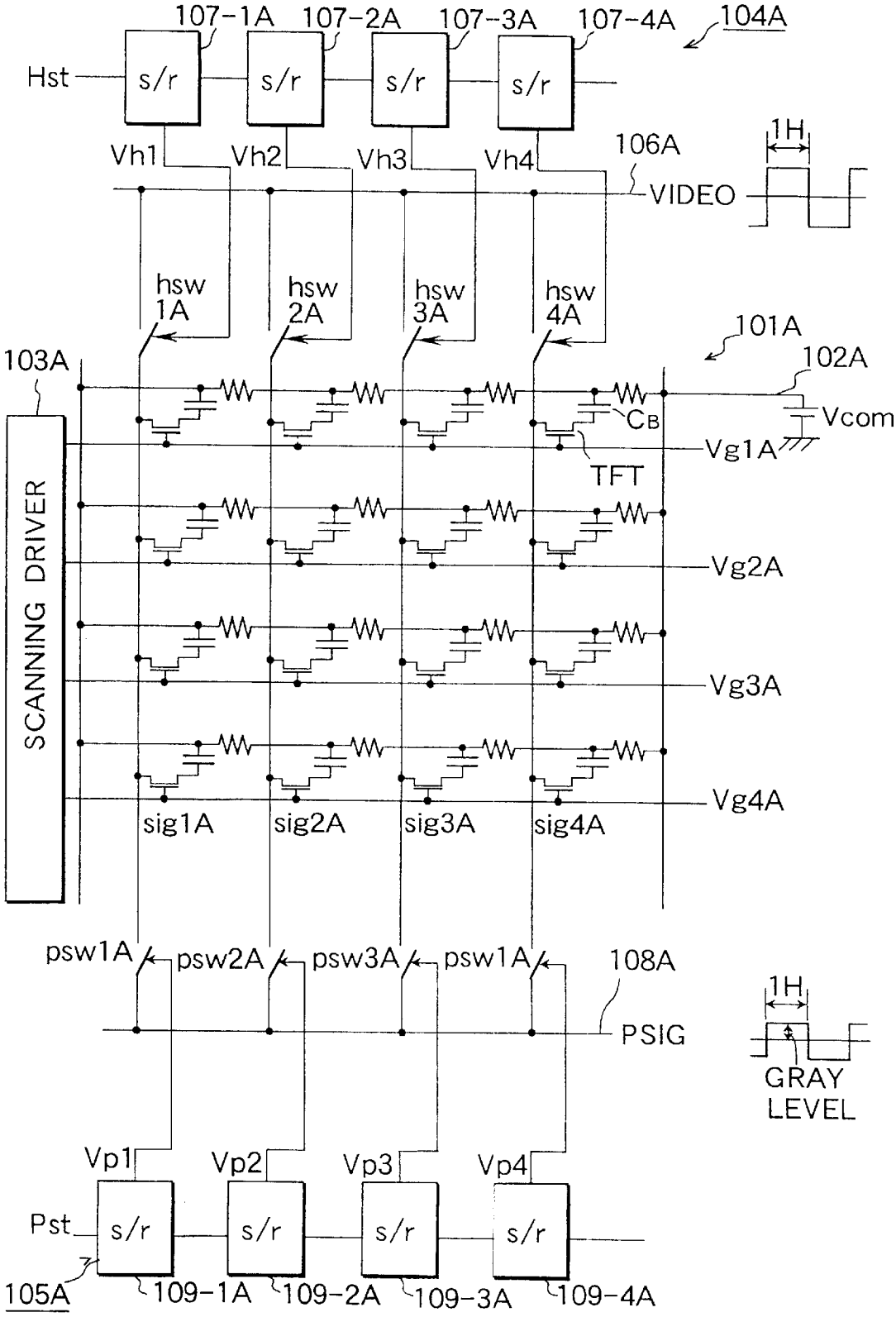
FIG.18 RELATED ART
FIG. 18 is a circuit diagram showing a related art of an active matrix type TFT liquid crystal display apparatus of the dot inversion driving system.
Figure 19:
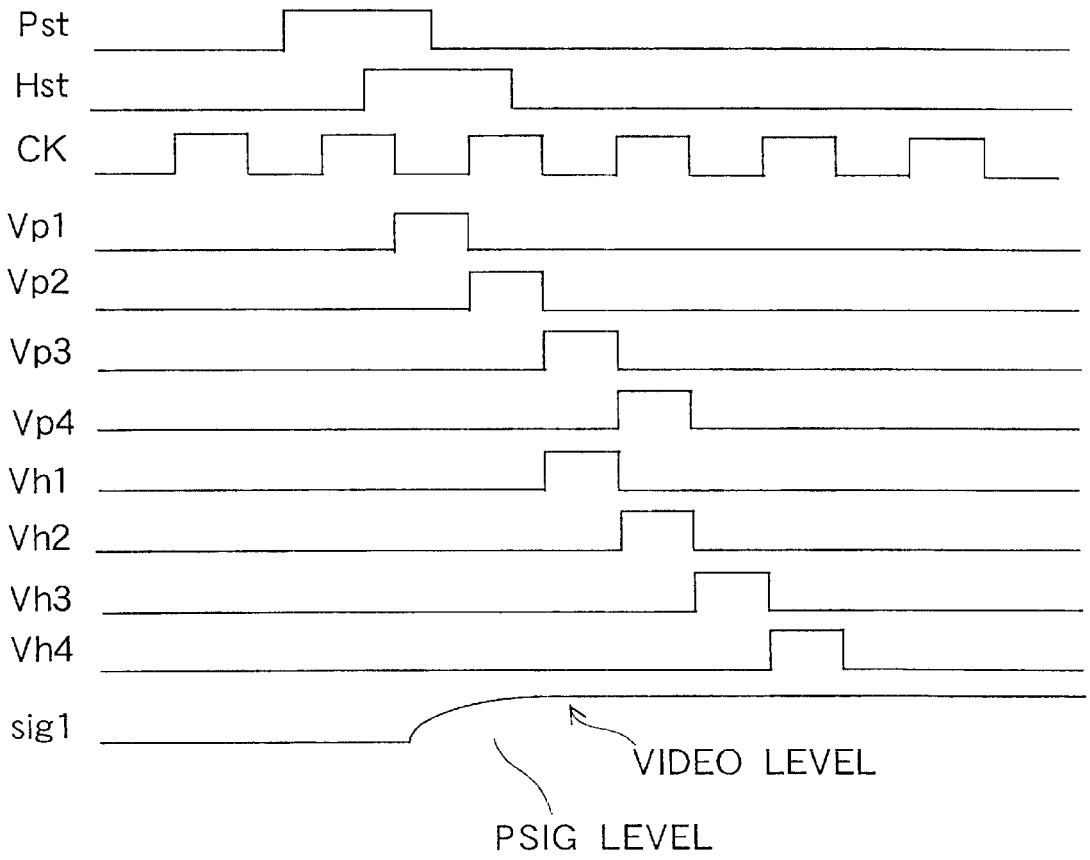
FIG.19 RELATED ART
FIG. 19 illustrates timing charts for explaining operation of the related art.
Figure 20:
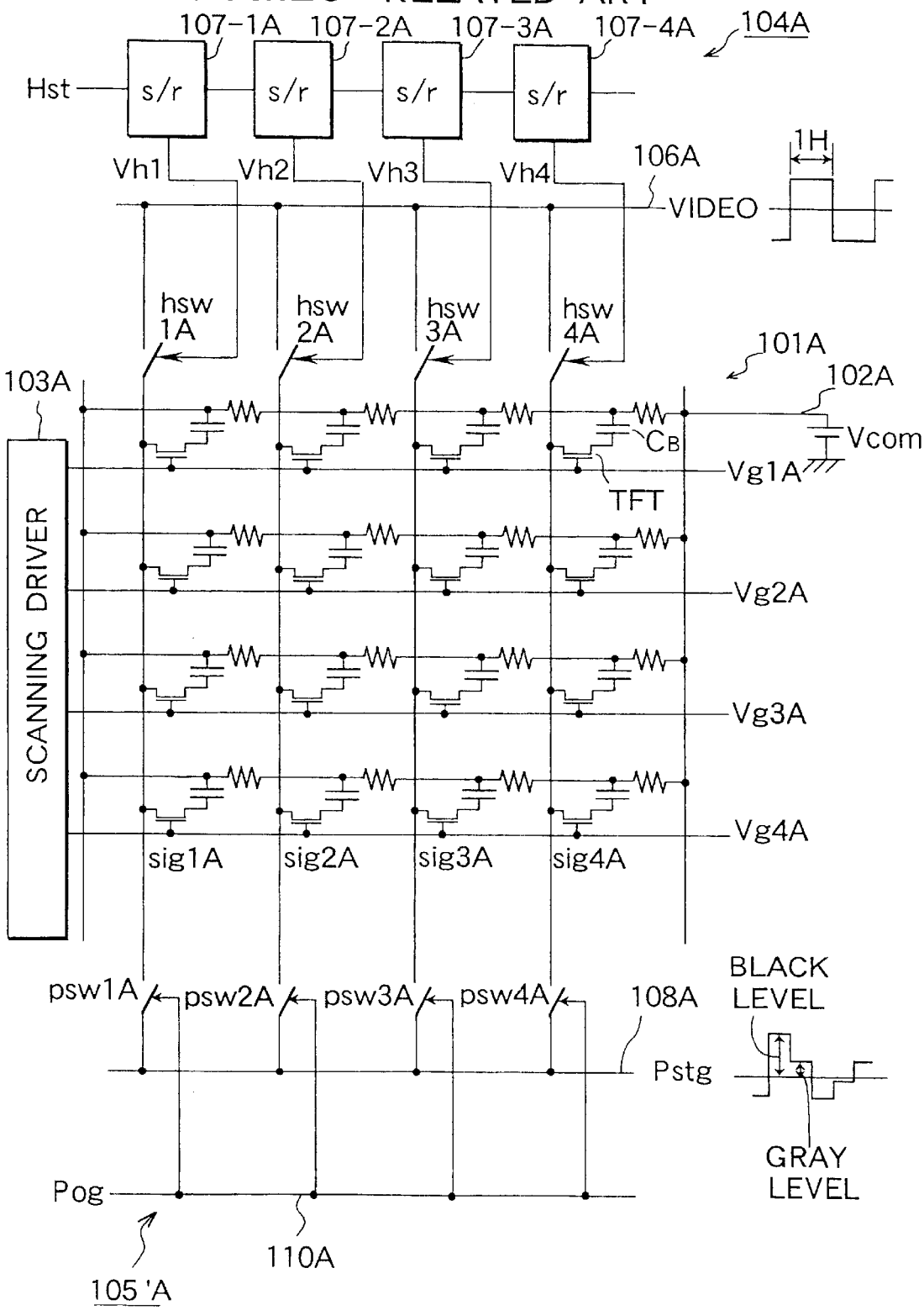
FIG.20 RELATED ART
FIG. 20 is a circuit diagram showing other related art of an active matrix type TFT liquid crystal display apparatus of the dot inversion driving system.

Next, an explanation will be given of operation of the active matrix type TFT liquid crystal display apparatus of the dot inversion driving system having the above-described constitution in reference to timing charts of FIG. 17.

First, the sampling pulses Vp1A through Vp3A are successively outputted from the respective transmitting stages 29-1A through 29-3A in the precharge drivers 25A in synchronism with the horizontal clock CK in response to the precharge start pulse Pst. In the meantime, the sampling pulses Vh1A and Vh2A are successively outputted from the respective transmitting stages 27-1A and 27-2A in synchronism with the horizontal clock CK in response to the horizontal start pulse Hst while being delayed by one clock of the horizontal clock CK relative to the sampling pulses Vp1A through Vp3A.

Further, when the first row is selected by the scanning driver 13, firstly, by making ON the sampling switches Pb1A and Pb2A in response to the sampling pulse Vp1, the precharge signal Psig-gray1 at the gray level in the positive polarity is written to the signal line sig1A and the precharge signal Psig-gray2 at the gray level in the inverse polarity is written to the signal line sig2A, respectively. Simultaneously therewith, the sampling switches Pb3A and Pb4A are also made ON in response to the sampling pulse Vp2 and accordingly, the precharge signals Psig-black1 and Psig-black2 at the black level in polarities inverse to each other are written also to the signal lines sig3A and sig4A.

Thereafter, when the sampling pulse Vh1 is produced at a timing of producing the sampling pulse Vp3, by making the sampling switches hsw1A and hsw2A ON in response to the sampling pulse Vh1, the image signal video1 having the positive polarity is written to the signal line sig1 and the image signal video2 having the inverse polarity is written to the signal line sig2, respectively. Thereafter, similarly, the precharge signals Psig-black1 and Psig-black2 at the black level and the precharge signals Psig-gray1 and Psig-gray2 are precharged in the dot successive manner in two steps and thereafter, the image signals video1 and video2 are written thereto in the dot successive manner to respectives of the signal lines sig3A and sig4A.

Further, although in this case, an explanation has been given of operation in the case in which the precharging operation in two steps and the writing operation of the video signals video1 and video2 are carried out in the dot successive manner in respect of the first row (first line), the precharging operation in two steps and the writing operation of the image signals video1 and video2 are carried out in the dot successive manner also in respect of the second row, the third row and the fourth row similar to the case of the first row.

As mentioned above, according to the active matrix type TFT liquid crystal display apparatus of the dot inversion driving system, by precharging in two steps and in the dot successive manner, the precharge signals Psig-black1 and Psig-black2 at the black level and the precharge signals Psig-gray1 and Psig-gray2 at the gray level to respectives of the signal lines sig1A through sig4A prior to writing the image signals video1 and video2 to respectives of the signal lines sig1A through sig4A, similar to the case of the first embodiment, failures in image quality can be improved by eliminating both of the vertical cross talk and vertical streak and since the precharging operation needs not to carry out in the horizontal blanking period, the present invention is applicable also to a liquid crystal apparatus having a number of pixels in accordance with high resolution formation, for example, a liquid crystal display apparatus of the UXGA display standard or the like.

Further, according to the active matrix type TFT liquid crystal display apparatus of the dot inversion driving system, as is apparent from the explanation of the above-described operation, the precharge signals Psig-black1 and Psig-black 2 at the black level, the precharge signals Psig-gray1 and Psig-gray2 at the gray level and the image signals video1 and video2 are written to the signal lines sig1A and sig2A as well as sig3A and sig4A in polarities inverse to each other and accordingly, there can be improved also a failure in image quality such as the shading in the screen or the like.

That is, there are provided resistor components RCs between contiguous left and right ones of the pixels 11A in the Cs line 12A and parasitic capacitances are present between the Cs lines and the signal lines sig1A through sig4A and accordingly, differentiating circuits are formed by the resistor components RCs, the hold capacitors Cs and the parasitic capacitances. Further, when changes in respective potentials of the signal line sig1A through sig4A in the precharging operation in two steps and the writing operation of the image signals video1 and video2, are inputted to the Cs lines 12A via the hold capacitors Cs and the parasitic capacitances, the potentials of the Cs lines 12A are deviated in the same polarity direction and accordingly, there is a concern of causing a failure in shading and significantly deteriorating image quality.

However, in the case of the active matrix type TFT liquid crystal display apparatus of the dot inversion driving system, the precharge signals Psig-black1 and Psig-black2, the precharge signals Psig-gray1 and Psig-gray2 and the image signals video1 and video2 are respectively written as signal levels inverse to each other to the signal lines sig1A and sig2A as well as sig3A and sig4A contiguous to each other and accordingly, the changes in the potentials of the signal lines sig1A through sig4A inputted to the Cs lines 12A via the hold capacitors Cs and the parasitic capacitances, are canceled and accordingly, the potentials of the Cs lines 12A are not deviated and therefore, the failure in image quality such as the shading in the screen or the like can be improved.

Further, although according to the second embodiment of the second aspect of the present invention, an explanation has been given of the case in which the present invention is applied to the active matrix type TFT liquid crystal display apparatus of the dot inversion driving system, the present invention is similarly applicable also to, for example, an active matrix type TFT liquid crystal display apparatus of the so-to-speak dot-line inversion driving system in which the apparatus is driven such that the image signals video1 and video2 having polarities inverse to each other are simultaneously written to the pixels of different lines (for example, two upper and lower lines) and polarities of the pixels in the pixel arrangement after the writing operation are made the same polarities between contiguous left and right ones of the pixels and inverse polarities between upper and lower ones of the pixels and also in this case, operation and effect similar to those in the second embodiment according to the second aspect of the present invention can be achieved.

Further, although according to the above-described respective embodiments, an explanation has been given of the case in which the present invention is applied to the liquid crystal apparatus mounted with the analog interface driving circuit for inputting the analog image signals video1 and video2 and sampling the analog image signals to thereby drive the respective pixels in the dot successive manner, the present invention is similarly applicable to a liquid crystal display apparatus mounted with a digital interface driving circuit in which digital image signals are inputted, latched, thereafter converted into analog image signals and the analog image signals after the conversion are sampled to thereby drive the respective pixels in the dot successive manner.

Further, although according to the respective embodiments of the second aspect of the present invention, there are used the precharge signals Psig-gray at the gray level as the precharge signals precharged immediately before writing the image signal video, the present invention is not limited necessarily to the precharge signals at the gray level but, for example, a signal level of a successively inputted image signal video can be predicted and an image signal having a level proximate to the signal level can be used as a precharge signal.

As has been explained, according to the second aspect of the present invention, in the active matrix type liquid crystal display apparatus of the dot successive driving system, by carrying out the precharging operation in two steps for respectives of the signal lines in the dot successive manner prior to writing the image signals, it is not necessary to carry out the precharging operation integrally in the horizontal blanking period and accordingly; the precharging operation in two steps can be realized even in an image format having a short horizontal blanking period and accordingly, the vertical cross talk and the vertical streak can be eliminated even in the case of the liquid crystal display apparatus having a number of pixels.

It is naturally apparent that although single embodiments of the first aspect of the present invention and the second aspect of the present invention have been shown according to the above-described embodiments of the present invention, the present invention is not limited thereto but the effect of the present invention can be achieved also in an LCD combined with both.

What is claimed is:

1. A liquid crystal display apparatus for successively driving respective pixels arranged in a matrix shape at respective lines in units of the pixels:

wherein image signals having polarities inverse to each other are inputted, the image signals having the polarities inverse to each other are simultaneously written to the pixels of different ones of the lines and in a pixel arrangement after having written the image signals, the polarities of the pixels constitute the same polarity between contiguous left and right ones of the pixels and inverse polarities between upper and lower ones of the pixels, wherein gate lines of pixel transistors of the respective pixels arranged in the matrix shape are wired to meander between the pixels at two upper and lower ones of the lines.

2. The liquid crystal display apparatus according to claim 1, wherein connecting lines for commonly connecting electrodes of hold capacitors of the respective pixels arranged in the matrix shape are wired in a matrix shape.

3. A method of driving a liquid crystal display apparatus for successively driving respective pixels arranged in a matrix shape at respective lines in units of the pixels, said method comprising:

inputting image signals having polarities inverse to each other; and writing the image signals having the polarities inverse to each other simultaneously to the pixels at different ones of the lines, wherein the apparatus is driven such that the polarities of the pixels in a pixel arrangement after having written the image signals constitute the same polarity between contiguous left and right ones of the pixels and inverse polarities between upper and lower ones of the pixels, wherein gate lines of pixel transistors of the respective pixels arranged in the matrix shape are wired to meander between the pixels at two upper and lower ones of the lines.

4. A liquid crystal display system comprising:

liquid crystal displaying means for adopting a drive system of successively driving respective pixels arranged in a matrix shape at respective lines in units of the pixels, inputting image signals having polarities inverse to each other, writing the image signals having the polarities inverse to each other simultaneously to the pixels at different ones of the lines and making the polarities of the pixels in a pixel arrangement after having written the image signals the same polarity between contiguous left and right ones of the pixels and inverse polarities between upper and lower ones of the pixels;

delay processing means for inputting the image signals of odd number ones of the pixels and the image signals of even number ones of the pixels by being shifted from each other over time by a time period in correspondence with a predetermined number of the lines; and driving means for driving the liquid crystal display apparatus based on the image signals of the odd number ones of the pixels and the image signals of the even number ones of the pixels after having been processed by the delay processing means, wherein gate lines of pixel transistors of the pixels arranged in the matrix shape are wired to meander between the pixels of two upper and lower ones of the lines in the liquid crystal displaying means.

5. The liquid crystal display system according to claim 4, wherein connecting lines for connecting electrodes of hold capacitors of the respective pixels arranged in the matrix shape commonly among the pixels are wired in a matrix shape in the liquid crystal displaying means.

6. The liquid crystal display system according to claim 4, wherein the delay processing means comprises:

delaying means in which the time period in correspondence with the predetermined number of the lines constitutes a delay time period; and selecting means in which two inputs thereof are constituted by the image signals of the odd number ones of the pixels and the image signals of the even number ones of the pixels and either of the two inputs is selected in accordance with a scan direction control signal and supplied to the delaying means.

* * * * *